US009736609B2

(12) United States Patent
Morrell et al.

(10) Patent No.: US 9,736,609 B2
(45) Date of Patent: Aug. 15, 2017

(54) DETERMINING RENDERERS FOR SPHERICAL HARMONIC COEFFICIENTS

(71) Applicant: QUALCOMM Incorporated, San Diego, CA (US)

(72) Inventors: Martin James Morrell, San Diego, CA (US); Nils Günther Peters, San Diego, CA (US); Dipanjan Sen, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 580 days.

(21) Appl. No.: 14/174,784

(22) Filed: Feb. 6, 2014

(65) Prior Publication Data

US 2014/0219456 A1 Aug. 7, 2014

Related U.S. Application Data

(60) Provisional application No. 61/762,302, filed on Feb. 7, 2013, provisional application No. 61/829,832, filed on May 31, 2013.

(51) Int. Cl.
*H04S 5/00* (2006.01)
*H04S 7/00* (2006.01)

(52) U.S. Cl.
CPC ..... *H04S 5/00* (2013.01); *H04S 7/30* (2013.01); *H04S 7/301* (2013.01); *H04S 2400/11* (2013.01); *H04S 2420/11* (2013.01)

(58) Field of Classification Search
CPC ... H04S 5/00; H04S 7/30; H04S 7/301; H04S 2420/11; H04S 2400/11; H04S 1/002; G10L 19/008
See application file for complete search history.

(56) References Cited

U.S. PATENT DOCUMENTS 6,904,152 B1 * 6/2005 Moorer ..... H04S 5/005 381/17
7,113,610 B1 9/2006 Chrysanthakopoulos
7,693,709 B2 4/2010 Thumpudi et al.
7,706,543 B2 4/2010 Daniel
(Continued)

FOREIGN PATENT DOCUMENTS

CN 1735922 A 2/2006
CN 101133679 A 2/2008
(Continued)

OTHER PUBLICATIONS

"Information technology—High efficiency coding and media delivery in heterogeneous environments—Part 3: 3D Audio," ISO/IEC JTC 1/SC 29, Jul. 25, 2014, 433 pp.
(Continued)

*Primary Examiner* — Thomas Alunkal
(74) *Attorney, Agent, or Firm* — Shumaker & Sieffert, P.A.

(57) ABSTRACT

In general, techniques are described for determining renderers used for rendering spherical harmonic coefficients to generate one or more loudspeaker signals. A device comprising one or more processors may perform the techniques. The one or more processors may be configured to determine a local speaker geometry of one or more speakers used for playback of spherical harmonic coefficients representative of a sound field, and configure the device to operate based on the local speaker geometry.

29 Claims, 21 Drawing Sheets

(56) References Cited

U.S. PATENT DOCUMENTS

| | | | | |
|---|---|---|---|---|
| 8,054,980 | B2 | 11/2011 | Wu et al. | |
| 8,437,485 | B2 | 5/2013 | Kuhn-Rahloff et al. | |
| 8,605,910 | B2 | 12/2013 | Franck et al. | |
| 9,100,768 | B2 | 8/2015 | Batke et al. | |
| 9,154,896 | B2 * | 10/2015 | Mahabub | H04S 5/00 |
| 9,338,574 | B2 | 5/2016 | Jax et al. | |
| 2002/0164037 | A1 | 11/2002 | Sekine | |
| 2004/0264704 | A1 | 12/2004 | Huin et al. | |
| 2006/0045275 | A1 | 3/2006 | Daniel | |
| 2006/0045294 | A1 | 3/2006 | Smyth | |
| 2006/0133628 | A1 | 6/2006 | Trivi et al. | |
| 2007/0025560 | A1 | 2/2007 | Asada | |
| 2009/0067636 | A1 * | 3/2009 | Faure | H04S 1/00 381/17 |
| 2010/0092014 | A1 | 4/2010 | Strauss et al. | |
| 2010/0098274 | A1 * | 4/2010 | Hannemann | H04R 1/403 381/300 |
| 2011/0249821 | A1 | 10/2011 | Jaillet et al. | |
| 2011/0252950 | A1 | 10/2011 | Trivi et al. | |
| 2011/0305344 | A1 * | 12/2011 | Sole | G10L 19/008 381/22 |
| 2012/0014527 | A1 * | 1/2012 | Furse | H04S 3/00 381/17 |
| 2012/0093344 | A1 * | 4/2012 | Sun | H04R 3/005 381/122 |
| 2012/0114137 | A1 | 5/2012 | Tsurumi | |
| 2012/0259442 | A1 * | 10/2012 | Jin | H04S 7/30 700/94 |
| 2013/0148812 | A1 * | 6/2013 | Corteel | H04S 7/30 381/17 |
| 2013/0216070 | A1 * | 8/2013 | Keiler | G10L 19/008 381/300 |
| 2014/0016802 | A1 * | 1/2014 | Sen | H04S 3/002 381/307 |
| 2014/0153744 | A1 | 6/2014 | Brannmark et al. | |
| 2014/0219455 | A1 | 8/2014 | Peters et al. | |
| 2014/0219456 | A1 | 8/2014 | Morrell et al. | |
| 2014/0358565 | A1 | 12/2014 | Peters et al. | |
| 2015/0163615 | A1 | 6/2015 | Boehm et al. | |
| 2015/0264483 | A1 | 9/2015 | Morrell et al. | |
| 2015/0312676 | A1 | 10/2015 | Ekstrand | |

FOREIGN PATENT DOCUMENTS

| | | | |
|---|---|---|---|
| CN | 101868984 | A | 10/2010 |
| CN | 101874414 | A | 10/2010 |
| CN | 103635964 | A | 3/2014 |
| EP | 2541547 | A1 | 1/2013 |
| JP | 4338102 | B1 | 10/2009 |
| TW | 200623933 | | 7/2006 |
| TW | 201246060 | A | 11/2012 |
| WO | 9318630 | A1 | 9/1993 |
| WO | 0182651 | A1 | 11/2001 |
| WO | 2007004362 | A1 | 1/2007 |
| WO | 2015059081 | A1 | 4/2015 |

OTHER PUBLICATIONS

"Information technology—High efficiency coding and media delivery in heterogeneous environments—Part 3: 3D Audio," ISO/IEC JTC 1/SC 29N, Apr. 4, 2014, 337 pp.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, Jul. 25, 2015, 208 pp.

Arora et al., "Low Complexity Virtual Bass Enhancement Algorithm for Portable Multimedia Device," AES 29th International Conference, Sep. 2-4, 2006, 4 pp.

Daniel et al., "Further Study of Sound Field Coding with Higher Order Ambisonics," Improved Sound Field Coding with Higher Order Ambisonics, AES 116th Convention, Convention Paper, May 8-11, 2004, 14 pp.

Poletti, "Three-Dimensional Surround Sound Systems Based on Spherical Harmonics," J. Audio Eng. Soc., vol. 53, No. 11, Nov. 2005, pp. 1004-1025.

Sen et al., "Technical Description of the Qualcomm's HOA Coding Technology for Phase II," ISO/IEC JTC/SC29/ WG11 MPEG 2014/M34104, Jul. 2014, 4 pp.

Boehm, "Decoding for 3D," AES Convention 130; May 2011, AES, 60 East 42nd Street, room 2520 New york 10165-2520, USA, May 13, 2011 (May 13, 2011), pp. 1-16, XP040567441, Section 3.

Audio, "Call for Proposals for 3D Audio," International Organisation for Standardisation Organisation Internationale De Normalisation ISO/IEC JTC1/SC29/WG11 Coding of Moving Pictures and Audio, ISO/IEC JTC1/SC29/WG11/N13411, Geneva, Jan. 2013, 20 pp.

Painter, et al., Perceptual Coding of Digital Audio, Proceedings of the IEEE, vol. 88, No. 4, Apr. 2000, pp. 451-513.

Poletti, "Unified Description of Ambisonics Using Real and Complex Sperical Harmonics," Ambisonics Symposium, Jun. 2009, 10 pp.

Sen, et al., "Differences and Similarities in formats for scene based audio," ISO/IEC JTC1/SC29/WG11 MPEG2012/M26704, Oct. 2012, 7 pp.

Zotter, et al., "Comparison of energy-preserving and all-around Ambisonic decoders," AIA-DAGa, Mar. 18-21, 2013, 4 pp.

International Search Report and Written Opinion from International Application No. PCT/US2014/015311, dated Jun. 11, 2014, 10 pp.

Response to Written Opinion dated Jun. 11, 2014, from International Application No. PCT/US2014/015311, filed on Nov. 24, 2014, 35 pp.

Second Written Opinion from International Application No. PCT/US2014/015311, dated Dec. 23, 2014, 7 pp.

Response to Second Written Opinion, dated Dec. 23, 2014 from International Application No. PCT/US2014/015311, filed on Feb. 20, 2015, 18 pp.

International Preliminary Report on Patentability from International Application No. PCT/US2014/015311, dated May 12, 2015, 9 pp.

Herre, et al., "MPEG-H 3D Audio—The New Standard for Coding of Immersive Spatial Audio," IEEE Journal of Selected Topics in Signal Processing, vol. 9, No. 5, Aug. 2015, 10 pp.

Information technology—MPEG audio technologies—Part 3: Unified speech and audio coding, ISO/IEC JTC 1/SC 26/ WG 11, Sep. 20, 2011, 291 pp.

* cited by examiner

DETERMINING RENDERERS FOR SPHERICAL HARMONIC COEFFICIENTS

This application claims the benefit of U.S. Provisional Application No. 61/829,832, filed May 31, 2013 and U.S. Provisional Application No. 61/762,302, filed Feb. 7, 2013.

TECHNICAL FIELD

This disclosure relates to audio rendering and, more specifically, rendering of spherical harmonic coefficients.

BACKGROUND

A higher order ambisonics (HOA) signal (often represented by a plurality of spherical harmonic coefficients (SHC) or other hierarchical elements) is a three-dimensional representation of a sound field. This HOA or SHC representation may represent this sound field in a manner that is independent of the local speaker geometry used to playback a multi-channel audio signal rendered from this SHC signal. This SHC signal may also facilitate backwards compatibility as this SHC signal may be rendered to well-known and highly adopted multi-channel formats, such as a 5.1 audio channel format or a 7.1 audio channel format. The SHC representation therefore enables a better representation of a sound field that also accommodates backward compatibility.

SUMMARY

In general, techniques are described for determining an audio renderer that suits a particular local speaker geometry. While the SHC may accommodate well-known multi-channel speaker formats, commonly the end-user listener does not properly place or locate the speakers in the manner required by these multi-channel formats, resulting in irregular speaker geometries. The techniques described in this disclosure may determine the local speaker geometry and then determine a renderer for rendering the SHC signals based on this local speaker geometry. The rendering device may select from among a number of different renderers, e.g., a mono renderer, a stereo renderer, a horizontal only renderer or a three-dimensional renderer, and generate this renderer based on the local speaker geometry. This renderer may account for irregular speaker geometries and thereby facilitate better reproduction of the sound field despite irregular speaker geometries in comparison to a regular renderer designed for regular speaker geometries.

Moreover, the techniques may render to a uniform speaker geometry, which may be referred to as a virtual speaker geometry, so as to maintain invertibility and recover the SHC. The techniques may then perform various operations to project these virtual speakers to different horizontal planes (which may a different elevation than the horizontal plane on which the virtual speaker was originally located). The techniques may enable a device to generate a renderer that maps these projected virtual speakers to different physical speakers arranged in an irregular speaker geometry. Projecting these virtual speakers in this manner may facilitate better reproduction of the sound field.

In one example, a method comprises determining a local speaker geometry of one or more speakers used for playback of spherical harmonic coefficients representative of a sound field, and determining a two-dimensional or three-dimensional renderer based on the local speaker geometry.

In another example, a device comprises one or more processors configured to determine a local speaker geometry of one or more speakers used for playback of spherical harmonic coefficients representative of a sound field and configure the device to operate based on the determined local speaker geometry.

In another example, a device comprises means for determining a local speaker geometry of one or more speakers used for playback of spherical harmonic coefficients representative of a sound field, and means for determining a two-dimensional or three-dimensional renderer based on the local speaker geometry.

In another example, a non-transitory computer-readable storage medium has stored thereon instructions that, when executed, cause one or more processors to determine a local speaker geometry of one or more speakers used for playback of spherical harmonic coefficients representative of a sound field, and determine a two-dimensional or three-dimensional renderer based on the local speaker geometry.

In another example, a method comprises determining a difference in position between one of a plurality of physical speakers and one of a plurality of virtual speakers arranged in a geometry, and adjusting a position of the one of the plurality of virtual speakers within the geometry based on the determined difference in position and prior to mapping the plurality of virtual speakers to the plurality of physical speakers.

In another example, a device comprises one or more processors configured to determine a difference in position between one of a plurality of physical speakers and one of a plurality of virtual speakers arranged in a geometry, and adjust a position of the one of the plurality of virtual speakers within the geometry based on the determined difference in position and prior to mapping the plurality of virtual speakers to the plurality of physical speakers.

In another example, a device comprises means for determining a difference in position between one of a plurality of physical speakers and one of a plurality of virtual speakers arranged in a geometry, and means for adjusting a position of the one of the plurality of virtual speakers within the geometry based on the determined difference in position and prior to mapping the plurality of virtual speakers to the plurality of physical speakers.

In another example, a non-transitory computer-readable storage medium has stored thereon instructions that, when executed, cause one or more processors to determine a difference in position between one of a plurality of physical speakers and one of a plurality of virtual speakers arranged in a geometry, and adjust a position of the one of the plurality of virtual speakers within the geometry based on the determined difference in position and prior to mapping the plurality of virtual speakers to the plurality of physical speakers.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
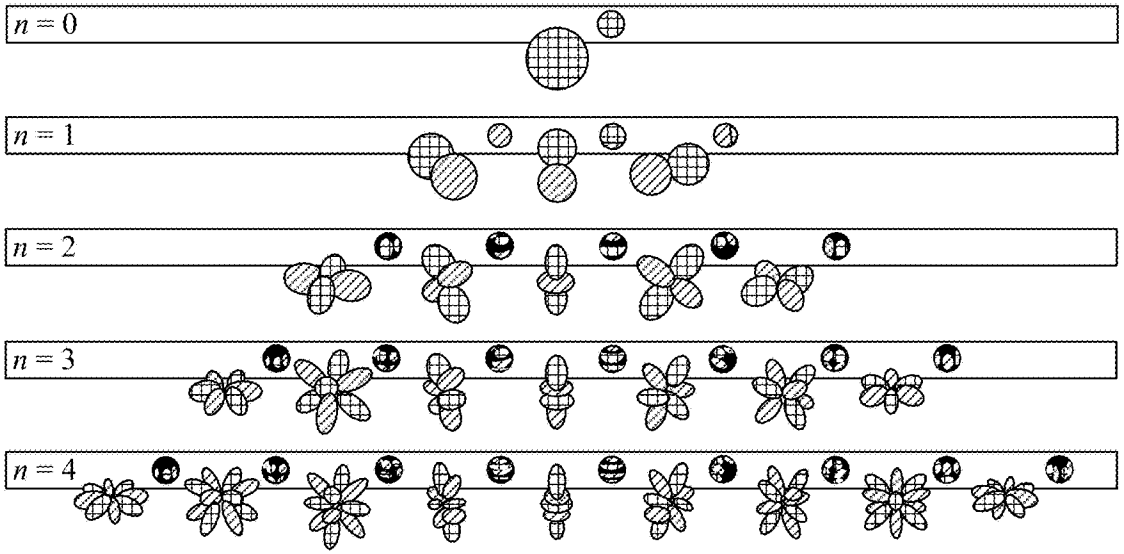
FIGS. 1 and 2 are diagrams illustrating spherical harmonic basis functions of various orders and sub-orders.

The evolution of surround sound has made available many output formats for entertainment nowadays. Examples of such surround sound formats include the popular 5.1 format (which includes the following six channels: front left (FL), front right (FR), center or front center, back left or surround left, back right or surround right, and low frequency effects (LFE)), the growing 7.1 format, and the upcoming 22.2 format (e.g., for use with the Ultra High Definition Television standard). Further examples include formats for a spherical harmonic array.

The input to a future MPEG encoder (which may generally be developed in response to a ISO/IEC JTC1/SC29/WG11/N13411 document, entitled "Call for Proposals for 3D Audio," dated January 2013 and published at the convention in Geneva, Switzerland) is optionally one of three possible formats: (i) traditional channel-based audio, which is meant to be played through loudspeakers at pre-specified positions; (ii) object-based audio, which involves discrete pulse-code-modulation (PCM) data for single audio objects with associated metadata containing their location coordinates (amongst other information); and (iii) scene-based audio, which involves representing the sound field using coefficients of spherical harmonic basis functions (also called "spherical harmonic coefficients" or SHC).

There are various 'surround-sound' formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios) would like to produce the soundtrack for a movie once, and not spend the efforts to remix it for each speaker configuration. Recently, standard committees have been considering ways in which to provide an encoding into a standardized bitstream and a subsequent decoding that is adaptable and agnostic to the speaker geometry and acoustic conditions at the location of the renderer.

To provide such flexibility for content creators, a hierarchical set of elements may be used to represent a sound field. The hierarchical set of elements may refer to a set of elements in which the elements are ordered such that a basic set of lower-ordered elements provides a full representation of the modeled sound field. As the set is extended to include higher-order elements, the representation becomes more detailed.

One example of a hierarchical set of elements is a set of spherical harmonic coefficients (SHC). The following expression demonstrates a description or representation of a sound field using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

This expression shows that the pressure $p_i$ at any point $\{r_r,\theta_r,\phi_r\}$ of the sound field can be represented uniquely by the SHC $A_n^m(k)$. Here, $k=\omega/c$, c is the speed of sound (~343 m/s), $\{r_r,\theta_r,\phi_r\}$ is a point of reference (or observation point), $j_n(\bullet)$ is the spherical Bessel function of order n, and $Y_n^m(\theta_r, \phi_r)$ are the spherical harmonic basis functions of order n and suborder m. It can be recognized that the term in square brackets is a frequency-domain representation of the signal (i.e., $S(\omega,r_r,\theta_r,\phi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 2 for ease of illustration purposes.

Figure 2:
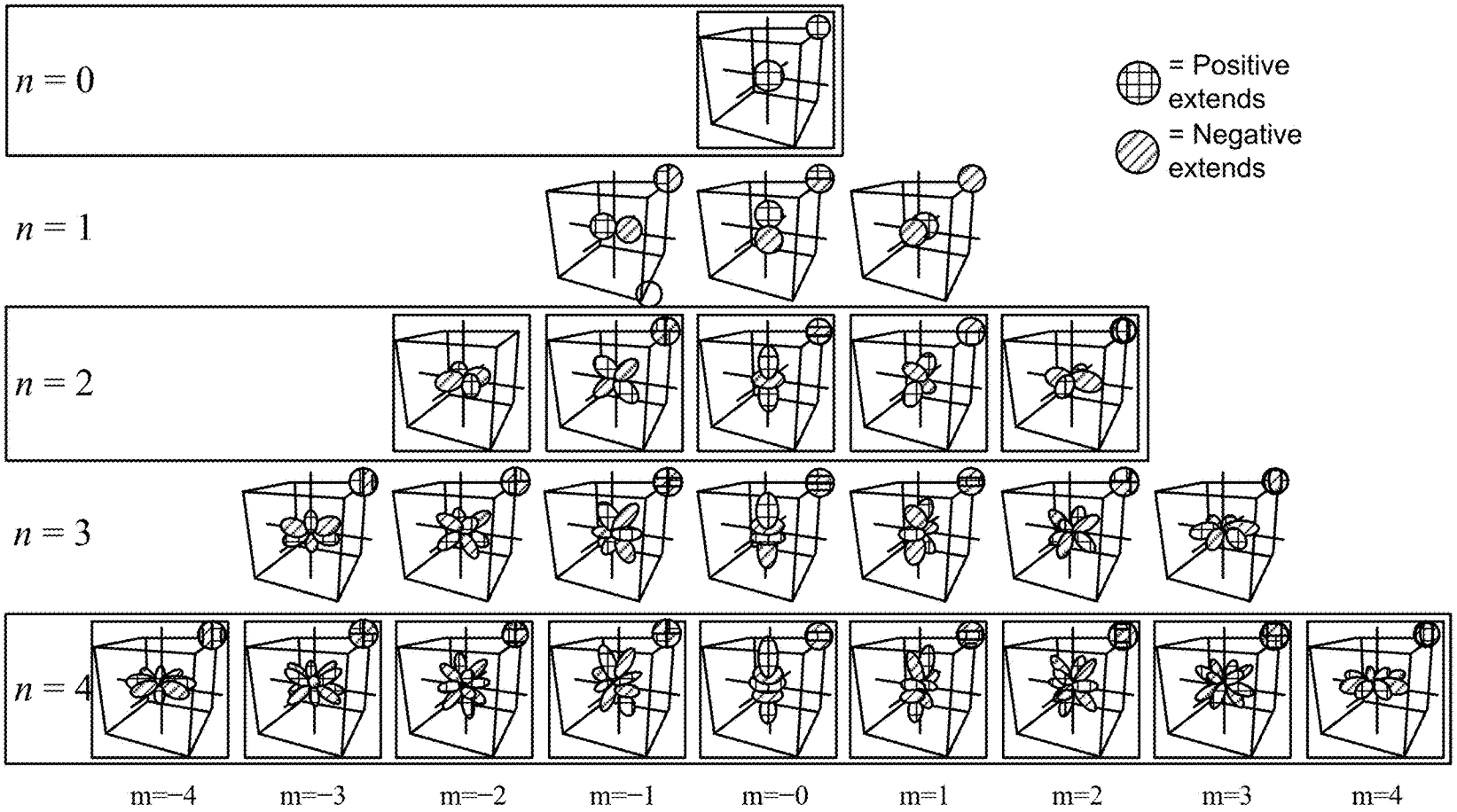

FIG. 2 is another diagram illustrating spherical harmonic basis functions from the zero order (n=0) to the fourth order (n=4). In FIG. 2, the spherical harmonic basis functions are shown in three-dimensional coordinate space with both the order and the suborder shown.

In any event, the SHC $A_n^m(k)$ can either be physically acquired (e.g., recorded) by various microphone array configurations or, alternatively, they can be derived from channel-based or object-based descriptions of the sound field. The former represents scene-based audio input to an encoder. For example, a fourth-order representation involving $1+2^4$ (25, and hence fourth order) coefficients may be used.

To illustrate how these SHCs may be derived from an object-based description, consider the following equation. The coefficients $A_n^m(k)$ for the sound field corresponding to an individual audio object may be expressed as $$A_n^m(k)=g(\omega)(-4\pi ik)h_n^{(2)}(kr_s)Y_n^{m*}(\theta_s,\phi_s),$$

where i is $\sqrt{-1}$, $h_n^{(2)}(\bullet)$ is the spherical Hankel function (of the second kind) of order n, and $\{r_s,\theta_s,\phi_s\}$ is the location of the object. Knowing the source energy $g(\omega)$ as a function of frequency (e.g., using time-frequency analysis techniques, such as performing a fast Fourier transform on the PCM stream) allows us to convert each PCM object and its location into the SHC $A_n^m(k)$. Further, it can be shown (since the above is a linear and orthogonal decomposition) that the $A_n^m(k)$ coefficients for each object are additive. In this manner, a multitude of PCM objects can be represented by the $A_n^m(k)$ coefficients (e.g., as a sum of the coefficient vectors for the individual objects). Essentially, these coefficients contain information about the sound field (the pressure as a function of 3D coordinates), and the above represents the transformation from individual objects to a representation of the overall sound field, in the vicinity of the observation point $\{r_r,\theta_r,\phi_r\}$. The remaining figures are described below in the context of object-based and SHC-based audio coding.

Figure 3:
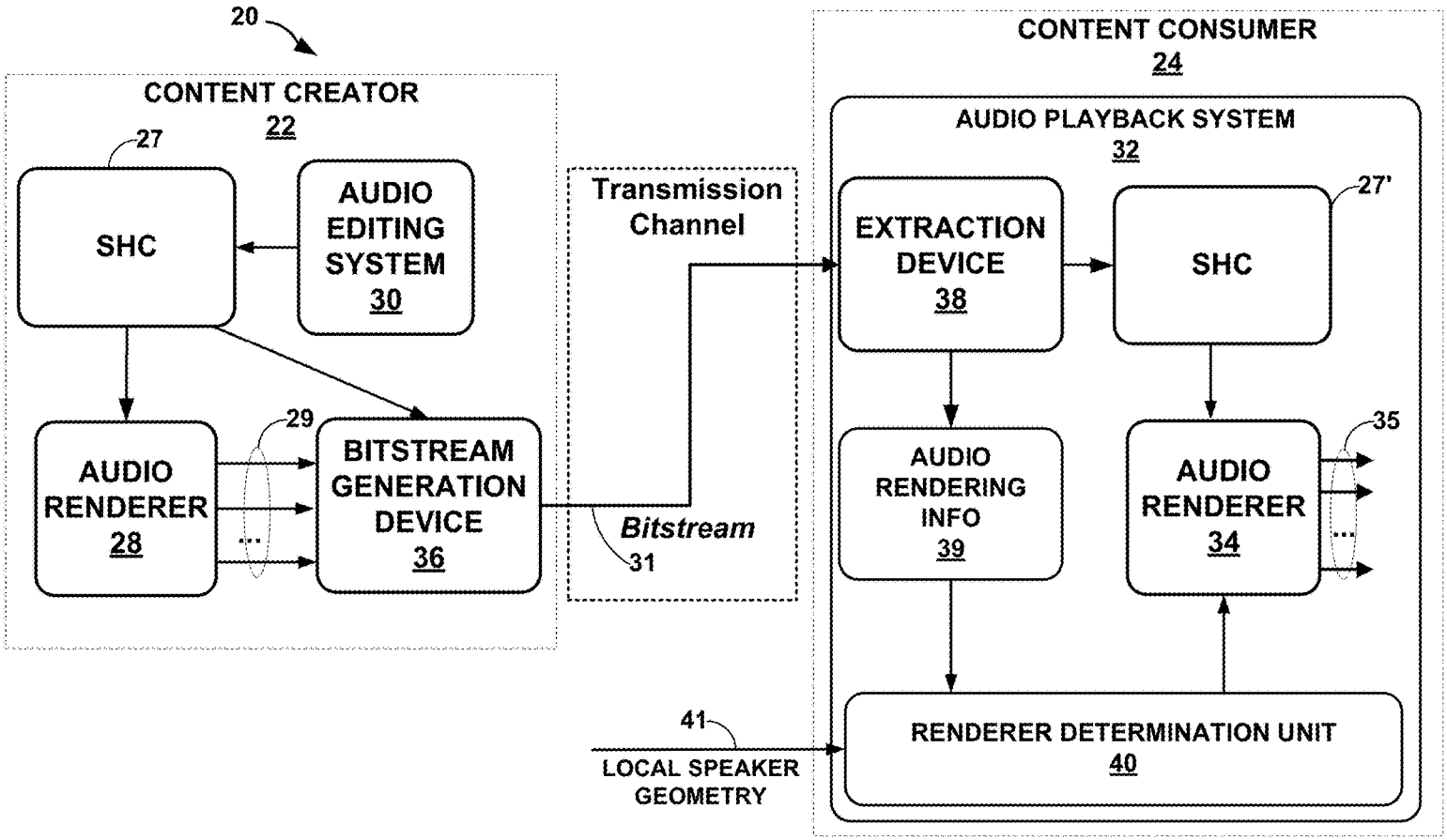
FIG. 3 is a diagram illustrating a system that may implement various aspects of the techniques described in this disclosure.

FIG. 3 is a diagram illustrating a system 20 that may perform various aspects of the techniques described in this disclosure. As shown in the example of FIG. 3, the system 20 includes a content creator 22 and a content consumer 24. The content creator 22 may represent a movie studio or other entity that may generate multi-channel audio content for consumption by content consumers, such as the content consumers 24. Often, this content creator generates audio content in conjunction with video content. The content consumer 24 represents an individual that owns or has access to an audio playback system 32, which may refer to any form of audio playback system capable of playing back multi-channel audio content. In the example of FIG. 3, the content consumer 24 includes an audio playback system 32.

The content creator 22 includes an audio renderer 28 and an audio editing system 30. The audio renderer 26 may represent an audio processing unit that renders or otherwise generates speaker feeds (which may also be referred to as "loudspeaker feeds," "speaker signals," or "loudspeaker signals"). Each speaker feed may correspond to a speaker feed that reproduces sound for a particular channel of a multi-channel audio system. In the example of FIG. 3, the renderer 38 may render speaker feeds for conventional 5.1, 7.1 or 22.2 surround sound formats, generating a speaker feed for each of the 5, 7 or 22 speakers in the 5.1, 7.1 or 22.2 surround sound speaker systems. Alternatively, the renderer 28 may be configured to render speaker feeds from source spherical harmonic coefficients for any speaker configuration having any number of speakers, given the properties of source spherical harmonic coefficients discussed above. The renderer 28 may, in this manner, generate a number of speaker feeds, which are denoted in FIG. 3 as speaker feeds 29.

The content creator may, during the editing process, render spherical harmonic coefficients 27 ("SHC 27"), listening to the rendered speaker feeds in an attempt to identify aspects of the sound field that do not have high fidelity or that do not provide a convincing surround sound experience. The content creator 22 may then edit source spherical harmonic coefficients (often indirectly through manipulation of different objects from which the source spherical harmonic coefficients may be derived in the manner described above). The content creator 22 may employ an audio editing system 30 to edit the spherical harmonic coefficients 27. The audio editing system 30 represents any system capable of editing audio data and outputting this audio data as one or more source spherical harmonic coefficients.

When the editing process is complete, the content creator 22 may generate the bitstream 31 based on the spherical harmonic coefficients 27. That is, the content creator 22 includes a bitstream generation device 36, which may represent any device capable of generating the bitstream 31. In some instances, the bitstream generation device 36 may represent an encoder that bandwidth compresses (by, as one example, entropy encoding) the spherical harmonic coefficients 27 and that arranges the bandwidth compressed version of the spherical harmonic coefficients 27 in an accepted format to form the bitstream 31. In other instances, the bitstream generation device 36 may represent an audio encoder (possibly, one that complies with a known audio coding standard, such as MPEG surround, or a derivative thereof) that encodes the multi-channel audio content 29 using, as one example, processes similar to those of conventional audio surround sound encoding processes to compress the multi-channel audio content or derivatives thereof. The compressed multi-channel audio content 29 may then be entropy encoded or coded in some other way to bandwidth compress content 29 and arranged in accordance with an agreed upon format to form the bitstream 31. Whether directly compressed to form the bitstream 31 or rendered and then compressed to form the bitstream 31, the content creator 22 may transmit the bitstream 31 to the content consumer 24.

While shown in FIG. 3 as being directly transmitted to the content consumer 24, the content creator 22 may output the bitstream 31 to an intermediate device positioned between the content creator 22 and the content consumer 24. This intermediate device may store the bitstream 31 for later delivery to the content consumer 24, which may request this bitstream. The intermediate device may comprise a file server, a web server, a desktop computer, a laptop computer, a tablet computer, a mobile phone, a smart phone, or any other device capable of storing the bitstream 31 for later retrieval by an audio decoder. Alternatively, the content creator 22 may store the bitstream 31 to a storage medium, such as a compact disc, a digital video disc, a high definition video disc or other storage mediums, most of which are capable of being read by a computer and therefore may be referred to as computer-readable storage mediums. In this context, the transmission channel may refer to those channels by which content stored to these mediums are transmitted (and may include retail stores and other store-based delivery mechanism). In any event, the techniques of this disclosure should not therefore be limited in this respect to the example of FIG. 3.

As further shown in the example of FIG. 3, the content consumer 24 includes an audio playback system 32. The audio playback system 32 may represent any audio playback system capable of playing back multi-channel audio data. The audio playback system 32 may include a number of different renderers. The audio playback system 32 may also include a renderer determination unit 40 that may represent a unit configured to determine or otherwise select an audio renderer 34 from among a plurality of audio renderers. In some instances, the renderer determination unit 40 may select the renderer 34 from a number of pre-defined renderers. In other instances, the renderer determination unit 40 may dynamically determine the audio renderer 34 based on local speaker geometry information 41. The local speaker geometry information 41 may specify a location of each speaker coupled to the audio playback system 32 relative to the audio playback system 32, a listener, or any other identifiable region or location. Often, a listener may interface with the audio playback system 32 via a graphical user interface (GUI) or other form of interface to input the local speaker geometry information 41. In some instances, the audio playback system 32 may automatically (meaning, in this example, without requiring any listener intervention) determine the local speaker geometry information 41 often by emitting certain tones and measuring the tones via a microphone coupled to the audio playback system 32.

The audio playback system 32 may further include an extraction device 38. The extraction device 38 may represent any device capable of extracting spherical harmonic coefficients 27' ("SHC 27'," which may represent a modified form of or a duplicate of spherical harmonic coefficients 27) through a process that may generally be reciprocal to that of the bitstream generation device 36. The audio playback system 32 may receive the spherical harmonic coefficients 27' and invoke the extraction device 38 to extract the SHC 27' and, if specified or available, the audio rendering information 39.

In any event, each of the above renderers 34 may provide for a different form of rendering, where the different forms of rendering may include one or more of the various ways of performing vector-base amplitude panning (VBAP), one or more of the various ways of performing distance based amplitude panning (DBAP), one or more of the various ways of performing simple panning, one or more of the various ways of performing near field compensation (NFC) filtering and/or one or more of the various ways of performing wave field synthesis. The selected renderer 34 may then render spherical harmonic coefficients 27' to generate a number of speaker feeds 35 (corresponding to the number of loudspeakers electrically or possibly wirelessly coupled to audio playback system 32, which are not shown in the example of FIG. 3 for ease of illustration purposes).

Typically, the audio playback system 32 may select any one of a plurality of audio renderers and may be configured to select one or more of audio renderers depending on the source from which the bitstream 31 is received (such as a DVD player, a Blu-ray player, a smartphone, a tablet computer, a gaming system, and a television to provide a few examples). While any one of the audio renderers may be selected, often the audio renderer used when creating the content provides for a better (and possibly the best) form of rendering due to the fact that the content was created by the content creator 22 using this one of audio renderers, i.e., the audio renderer 28 in the example of FIG. 3. Selecting the one of the audio renderers 34 having a rendering form that is the same as or at least close to the rendering form of the local speaker geometry may provide for a better representation of the sound field that may result in a better surround sound experience for the content consumer 24.

The bitstream generation device may generate the bitstream 31 to include the audio rendering information 39 ("audio rendering info 39"). The audio rendering information 39 may include a signal value identifying an audio renderer used when generating the multi-channel audio content, i.e., the audio renderer 28 in the example of FIG. 4. In some instances, the signal value includes a matrix used to render spherical harmonic coefficients to a plurality of speaker feeds.

In some instances, the signal value includes two or more bits that define an index that indicates that the bitstream includes a matrix used to render spherical harmonic coefficients to a plurality of speaker feeds. In some instances, when an index is used, the signal value further includes two or more bits that define a number of rows of the matrix included in the bitstream and two or more bits that define a number of columns of the matrix included in the bitstream. Using this information and given that each coefficient of the two-dimensional matrix is typically defined by a 32-bit floating point number, the size in terms of bits of the matrix may be computed as a function of the number of rows, the number of columns, and the size of the floating point numbers defining each coefficient of the matrix, i.e., 32-bits in this example.

In some instances, the signal value specifies a rendering algorithm used to render spherical harmonic coefficients to a plurality of speaker feeds. The rendering algorithm may include a matrix that is known to both the bitstream generation device 36 and the extraction device 38. That is, the rendering algorithm may include application of a matrix in addition to other rendering steps, such as panning (e.g., VBAP, DBAP or simple panning) or NFC filtering. In some instances, the signal value includes two or more bits that define an index associated with one of a plurality of matrices used to render spherical harmonic coefficients to a plurality of speaker feeds. Again, both the bitstream generation device 36 and the extraction device 38 may be configured with information indicating the plurality of matrices and the order of the plurality of matrices such that the index may uniquely identify a particular one of the plurality of matrices. Alternatively, the bitstream generation device 36 may specify data in the bitstream 31 defining the plurality of matrices and/or the order of the plurality of matrices such that the index may uniquely identify a particular one of the plurality of matrices.

In some instances, the signal value includes two or more bits that define an index associated with one of a plurality of rendering algorithms used to render spherical harmonic coefficients to a plurality of speaker feeds. Again, both the bitstream generation device 36 and the extraction device 38 may be configured with information indicating the plurality of rendering algorithms and the order of the plurality of rendering algorithms such that the index may uniquely identify a particular one of the plurality of matrices. Alternatively, the bitstream generation device 36 may specify data in the bitstream 31 defining the plurality of matrices and/or the order of the plurality of matrices such that the index may uniquely identify a particular one of the plurality of matrices.

In some instances, the bitstream generation device 36 specifies audio rendering information 39 on a per audio frame basis in the bitstream. In other instances, bitstream generation device 36 specifies the audio rendering information 39 a single time in the bitstream.

The extraction device 38 may then determine audio rendering information 39 specified in the bitstream. Based on the signal value included in the audio rendering information 39, the audio playback system 32 may render a plurality of speaker feeds 35 based on the audio rendering information 39. As noted above, the signal value may in some instances include a matrix used to render spherical harmonic coefficients to a plurality of speaker feeds. In this case, the audio playback system 32 may configure one of the audio renderers 34 with the matrix, using this one of the audio renderers 34 to render the speaker feeds 35 based on the matrix.

In some instances, the signal value includes two or more bits that define an index that indicates that the bitstream includes a matrix used to render the spherical harmonic coefficients 27' to the speaker feeds 35. The extraction device 38 may parse the matrix from the bitstream in response to the index, whereupon the audio playback system 32 may configure one of the audio renderers 34 with the parsed matrix and invoke this one of the renderers 34 to render the speaker feeds 35. When the signal value includes two or more bits that define a number of rows of the matrix included in the bitstream and two or more bits that define a number of columns of the matrix included in the bitstream, the extraction device 38 may parse the matrix from the bitstream in response to the index and based on the two or more bits that define a number of rows and the two or more bits that define the number of columns in the manner described above.

In some instances, the signal value specifies a rendering algorithm used to render the spherical harmonic coefficients 27' to the speaker feeds 35. In these instances, some or all of the audio renderers 34 may perform these rendering algorithms. The audio playback device 32 may then utilize the specified rendering algorithm, e.g., one of the audio renderers 34, to render the speaker feeds 35 from the spherical harmonic coefficients 27'.

When the signal value includes two or more bits that define an index associated with one of a plurality of matrices used to render the spherical harmonic coefficients 27' to the speaker feeds 35, some or all of the audio renderers 34 may represent this plurality of matrices. Thus, the audio playback system 32 may render the speaker feeds 35 from the spherical harmonic coefficients 27' using the one of the audio renderers 34 associated with the index.

When the signal value includes two or more bits that define an index associated with one of a plurality of rendering algorithms used to render the spherical harmonic coefficients 27' to the speaker feeds 35, some or all of the audio renderers 34 may represent these rendering algorithms. Thus, the audio playback system 32 may render the speaker feeds 35 from the spherical harmonic coefficients 27' using one of the audio renderers 34 associated with the index.

Depending on the frequency with which this audio rendering information is specified in the bitstream, the extraction device 38 may determine the audio rendering information 39 on a per audio frame basis or a single time.

By specifying the audio rendering information 39 in this manner, the techniques may potentially result in better reproduction of the multi-channel audio content 35 and according to the manner in which the content creator 22 intended the multi-channel audio content 35 to be reproduced. As a result, the techniques may provide for a more immersive surround sound or multi-channel audio experience.

While described as being signaled (or otherwise specified) in the bitstream, the audio rendering information 39 may be specified as metadata separate from the bitstream or, in other words, as side information separate from the bitstream. The bitstream generation device 36 may generate this audio rendering information 39 separate from the bitstream 31 so as to maintain bitstream compatibility with (and thereby enable successful parsing by) those extraction devices that do not support the techniques described in this disclosure. Accordingly, while described as being specified in the bitstream, the techniques may allow for other ways by which to specify the audio rendering information 39 separate from the bitstream 31.

Moreover, while described as being signaled or otherwise specified in the bitstream 31 or in metadata or side information separate from the bitstream 31, the techniques may enable the bitstream generation device 36 to specify a portion of the audio rendering information 39 in the bitstream 31 and a portion of the audio rendering information 39 as metadata separate from the bitstream 31. For example, the bitstream generation device 36 may specify the index identifying the matrix in the bitstream 31, where a table specifying a plurality of matrixes that includes the identified matrix may be specified as metadata separate from the bitstream. The audio playback system 32 may then determine the audio rendering information 39 from the bitstream 31 in the form of the index and from the metadata specified separately from the bitstream 31. The audio playback system 32 may, in some instances, be configured to download or otherwise retrieve the table and any other metadata from a pre-configured or configured server (most likely hosted by the manufacturer of the audio playback system 32 or a standards body).

However, as is often the case, the content consumer 24 does not properly configure the speakers according to a specified (typically by the surround sound audio format body) geometry. Often, the content consumer 24 does not place the speakers at a fixed height and in precisely the specified location relative to the listener. The content consumer 24 may be unable to place speakers in these location or be unaware that there are even specified locations at which to place speakers to achieve a suitable surround sound experience. Using SHC enables a more flexible arrangement of speakers given that the SHC represent the sound field in two or three dimensions, meaning that from the SHC, an acceptable (or at least better sounding, in comparison to that of non-SHC audio systems) reproduction of sound field may be provided by speakers configured in most any speaker geometry.

To facilitate rendering of the SHC to most any local speaker geometry, the techniques described in this disclosure may enable the renderer determination unit 40 not only to select a standard renderer using the audio rendering information 39 in the manner described above but to dynamically generate a renderer based on the local speaker geometry information 41. As described in more detail with respect to FIGS. 4-12C, the techniques may provide for at least four exemplary ways by which to generate a renderer 34 tailored to a specific local speaker geometry specified by the local speaker geometry information 41. These three ways may include a way by which to generate a mono renderer 34, a stereo renderer 34, a horizontal multi-channel renderer 34 (where, for example, "horizontal multi-channel" refers to a multi-channel speaker configuration having more than two speakers in which all of the speakers are generally on or near the same horizontal plane), and a three-dimensional (3D) renderer 34 (where a three-dimensional renderer may render for multiple horizontal planes of speakers).

In operation, the audio determination unit 40 may select renderer 34 based on the audio rendering information 39 or the local speaker geometry information 41. Often, the content consumer 24 may specify a preference that the renderer determination unit 40 select the renderer 34 based on the audio rendering information 39 (when present, as this may not be present in all bitstreams) and, when not present, determine (or select if previously determined) the renderer 34 based on the local speaker geometry information 41. In some instances, the content consumer 24 may specify a preference that the renderer determination unit 40 determine (or select if previously determined) the renderer 34 based on the local speaker geometry information 41 without ever considering the audio rendering information 39 during the selection of the renderer 34. While only two alternatives are provided, any number of preferences may be specified for configuring how the renderer determination unit 40 selects the renderer 34 based on the audio rendering information 39 and/or the local speaker geometry 41. Accordingly, the techniques should not be limited in this respect to the two exemplary alternatives discussed above.

In any event, assuming that the renderer determination unit 40 is to determine the renderer 34 based on the local speaker geometry information 41, the renderer determination unit 40 may first categorize the local speaker geometry into one of the four categories briefly mentioned above. That is, the renderer determination unit 40 may first determine whether the local speaker geometry information 41 indicates that the local speaker geometry generally conforms to a mono speaker geometry, a stereo speaker geometry, a horizontal multi-channel speaker geometry having three or more speakers on the same horizontal plane or a three-dimensional multi-channel speaker geometry having three or more speakers, two of which are on different horizontal planes (often separated by some threshold height). Upon categorizing the local speaker geometry based on this local speaker geometry information 41, the renderer determination unit 40 may generate one of a mono renderer, a stereo renderer, a horizontal multi-channel renderer and a three-dimensional multi-channel renderer. The renderer determination unit 40 may then provide this renderer 34 for use by the audio playback system 32, whereupon the audio playback system 32 may render the SHC 27' in the manner described above to generate the multi-channel audio data 35.

In this way, the techniques may enable audio playback system 32 to determine a local speaker geometry of one or more speakers used for playback of spherical harmonic coefficients representative of a sound field, and determine a two dimensional or three dimensional renderer based on the local speaker geometry.

In some examples, the audio playback system 32 may render the spherical harmonic coefficients using the determined renderer to generate multi-channel audio data.

In some examples, the audio playback system 32 may, when determining the renderer based on the local speaker geometry, determine a stereo renderer when the local speaker geometry conforms to a stereo speaker geometry.

In some examples, the audio playback system 32 may, when determining the renderer based on the local speaker geometry, determine a horizontal multi-channel renderer when the local speaker geometry conforms to horizontal multi-channel speaker geometry having more than two speakers.

In some examples, the audio playback system 32 may, when determining the renderer based on the local speaker geometry, determine a three-dimensional multi-channel renderer when the local speaker geometry conforms a three-dimensional multi-channel speaker geometry having more than two speakers on more than one horizontal plane.

In some examples, the audio playback system 32 may, when determining the local speaker geometry of the one or more speakers, receive input from a listener specifying local speaker geometry information describing the local speaker geometry.

In some examples, the audio playback system 32 may, when determining the local speaker geometry of the one or more speakers, receive input via a graphical user interface from a listener specifying local speaker geometry information describing the local speaker geometry.

In some examples, the audio playback system 32 may, when determining the local speaker geometry of the one or more speakers, automatically determine local speaker geometry information describing the local speaker geometry.

The following is one way to summarize the foregoing techniques. Generally, a Higher Order Ambisonics signal, such as SHC 27, is a representation of a three-dimensional sound field using spherical harmonic basis functions, where at least one of the spherical harmonic basis functions are associated with a spherical basis function having an order greater than one. This representation may provide an ideal sound format as it is independent of end user speaker geometry and, as a result, the representation may be rendered to any geometry at the content consumer without prior knowledge on the encoding side. The final speaker signals may then be derived by linear combination of the spherical harmonic coefficients, which generally represent a polar pattern pointing in the direction of that particular speaker. Research has been done for designing specific HOA renderers for common speaker layouts such as 5.0/5.1 and also for generating renderers in real-time or near-real time (which is commonly referred to as "on the fly") for irregular 2D and 3D speaker geometries). The 'golden' case of regular (t-design) speaker geometry may be well known by using a pseudo-inverse based rendering matrix. In the case of the upcoming MPEG-H standard, a system may be required that can take any speaker geometry and use the correct methodology for producing the best rendering matrix for the speaker geometry in question.

Various aspects of the techniques described in this disclosure provide for an HOA or SHC renderer generation system/algorithm. The system detects what type of speaker geometry is in use: mono, stereo, horizontal, three-dimensional or flagged as a known geometry/renderer matrix.

Figure 4:
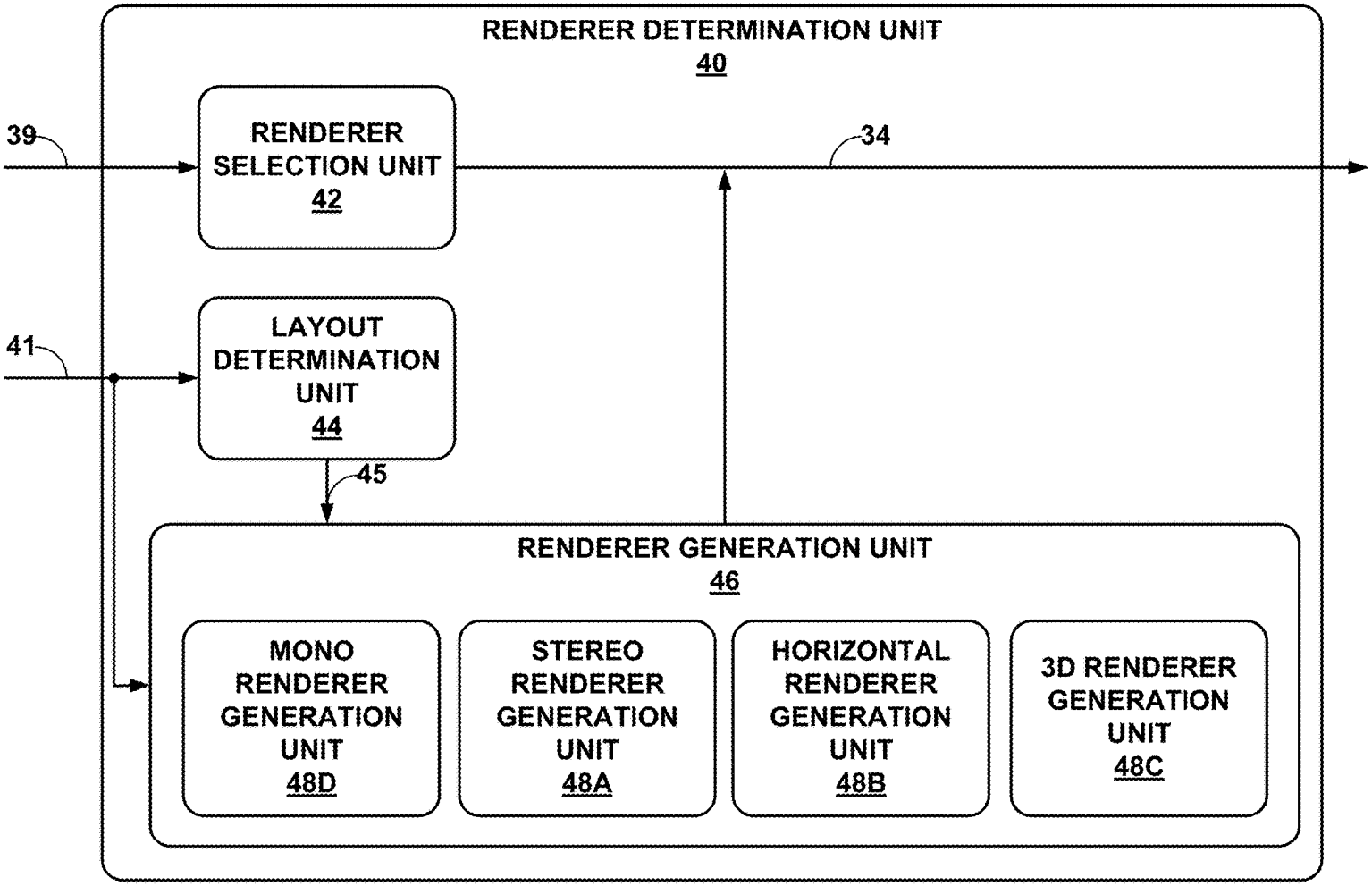
FIG. 4 is a diagram illustrating a system that may implement various aspects of the techniques described in this disclosure.

FIG. 4 is a block diagram illustrating the renderer determination unit 40 of FIG. 3 in more detail. As shown in the example of FIG. 4, the renderer determination unit 40 may include a renderer selection unit 42, a layout determination unit 44, and a renderer generation unit 46. The renderer selection unit 42 may represent a unit configured to select a pre-defined based on the rendering information 39 or select the render specified in the rendering information 39, outputting this selected or specified renderer as the renderer 34.

The layout determination unit 44 may represent a unit configured to categorize a local speaker geometry based on local speaker geometry information 41. The layout determination unit 44 may categorize the local speaker geometry to one of the three categories described above: 1) mono speaker geometry, 2) stereo speaker geometry, 3) a horizontal multi-channel speaker geometry, and 4) a three-dimensional multi-channel speaker geometry. The layout determination unit 44 may pass categorization information 45 to the renderer generation unit 46 that indicates to which of the three categories the local speaker geometry most conforms.

The renderer generation unit 46 may represent a unit configured to generate a renderer 34 based on the categorization information 45 and the local speaker geometry information 41. The renderer generation unit 46 may include a mono renderer generation unit 48D, a stereo renderer generation unit 48A, a horizontal renderer generation unit 48B, and a three-dimensional (3D) renderer generation unit 48C. The mono renderer generation unit 48A may represent a unit configured to generate a mono renderer based on the local speaker geometry information 41. The stereo renderer generation unit 48A may represent a unit configured to generate a stereo renderer based on the local speaker geometry information 41. The process employed by the stereo renderer generation unit 48A is described in more detail below with respect to the example of FIG. 6. The horizontal renderer generation unit 48B may represent a unit configured to generate a horizontal multi-channel renderer based on the local speaker geometry information 41. The process employed by the horizontal renderer generation unit 48B is described in more detail below with respect to the example of FIG. 7. The 3D renderer generation unit 48C may represent a unit configured to generate a 3D multi-channel renderer based on the local speaker geometry information 41. The process employed by the horizontal renderer generation unit 48B is described in more detail below with respect to the example of FIGS. 8 and 9.

Figure 5:
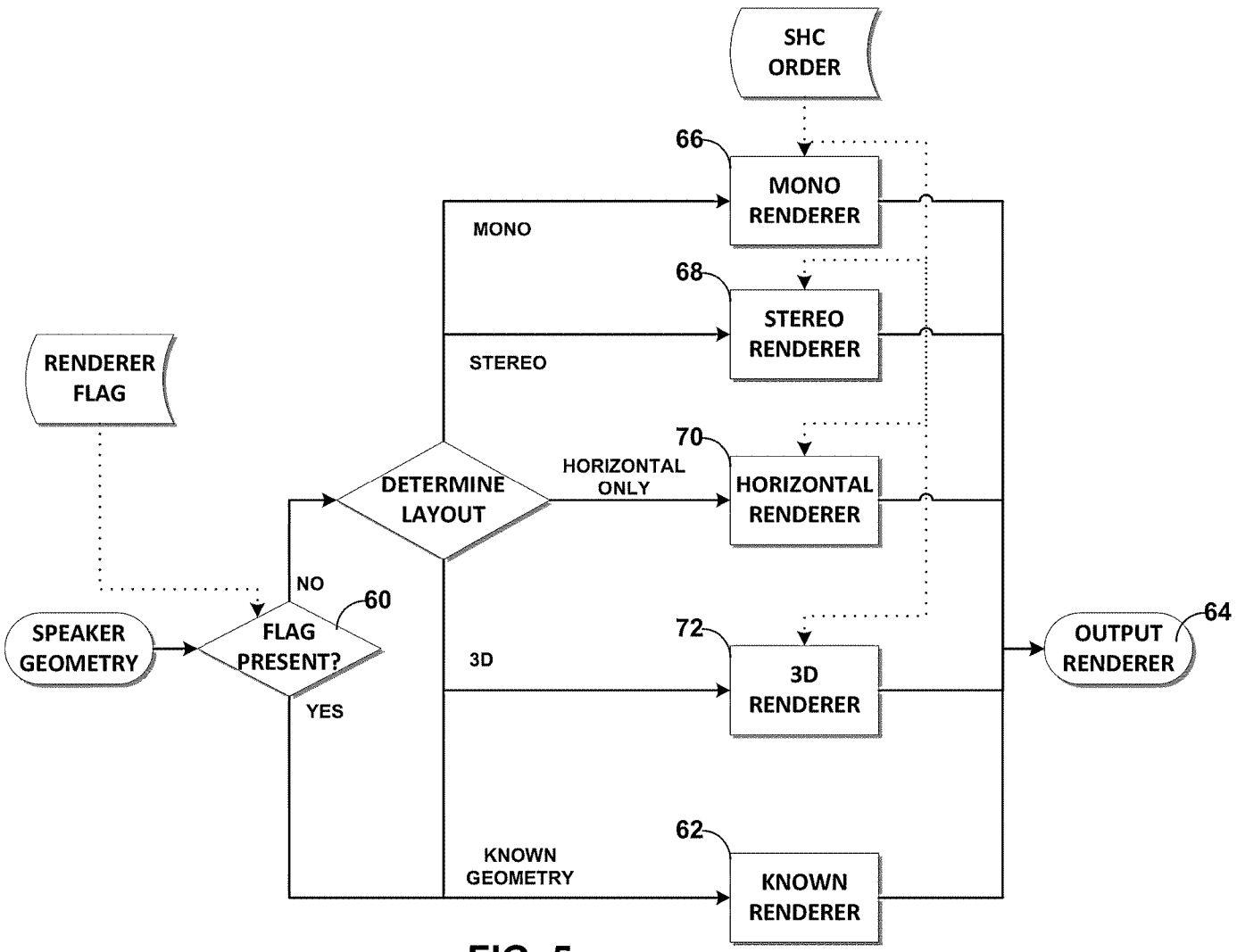
FIG. 5 is a flow diagram illustrating exemplary operation of the renderer determination unit shown in the example of FIG. 4 in performing various aspects of the techniques described in this disclosure.

FIG. 5 is a flow diagram illustrating exemplary operation of the renderer determination unit 40 shown in the example of FIG. 4 in performing various aspects of the techniques described in this disclosure. The flow diagram of FIG. 5 generally outlines the operations performed by the renderer determination unit 40 described above with respect to FIG. 4, except for some minor notation changes. In the example of FIG. 5, the renderer flag refers to a specific example of the audio rendering information 39. The "SHC order" refers to the maximum order of the SHC. The "stereo renderer" may refer to the stereo renderer generation unit 48A. The "horizontal renderer" may refer to the horizontal renderer generation unit 48B. The "3D renderer" may refer to the 3D renderer generation unit 48C. The "Renderer Matrix" may refer to the renderer selection unit 42.

As shown in the example of FIG. 5, the renderer selection unit 42 may receive determine whether the render flag, which may be denoted as the render flag 39', is present in the bitstream 31 (or other side channel information associated with the bitstream 31) (60). When the renderer flag 39' is present in the bitstream 31 ("YES" 60), the renderer selection unit 42 may select the renderer from a potential plurality of renderers based on the renderer flag 39' and output the selected renderer as the renderer 34 (62, 64).

When the renderer flag 39' is not present in the bitstream ("NO" 60), the renderer selection unit 42 may invoke the renderer determination unit 40, which may determine the local speaker geometry information 41. Based on the local speaker geometry information 41, the renderer determination unit 40 may invoke one of the mono renderer determination unit 48D, the speaker renderer determination unit 48A, the horizontal renderer determination unit 48B or the 3D renderer determination unit 48C.

When the local speaker geometry information 41 indicates a mono local speaker geometry, the render determination unit 40 may invoke the mono renderer determination unit 48D, which may determine a mono render (based potentially on the SHC order) and output the mono renderer as the renderer 34 (66, 64). When the local speaker geometry information 41 indicates a stereo local speaker geometry, the render determination unit 40 may invoke the stereo renderer determination unit 48A, which may determine a stereo render (based potentially on the SHC order) and output the stereo renderer as the renderer 34 (68, 64). When the local speaker geometry information 41 indicates a horizontal local speaker geometry, the render determination unit 40 may invoke the horizontal renderer determination unit 48B, which may determine a horizontal render (based potentially on the SHC order) and output the horizontal renderer as the renderer 34 (70, 64). When the local speaker geometry information 41 indicates a stereo local speaker geometry, the render determination unit 40 may invoke the 3D renderer determination unit 48C, which may determine a 3D render (based potentially on the SHC order) and output the 3D renderer as the renderer 34 (72, 64).

In this way, the techniques may enable the renderer determination unit 40 to determine a local speaker geometry of one or more speakers used for playback of spherical harmonic coefficients representative of a sound field, and determining a two-dimensional or three-dimensional renderer based on the local speaker geometry.

Figure 6:
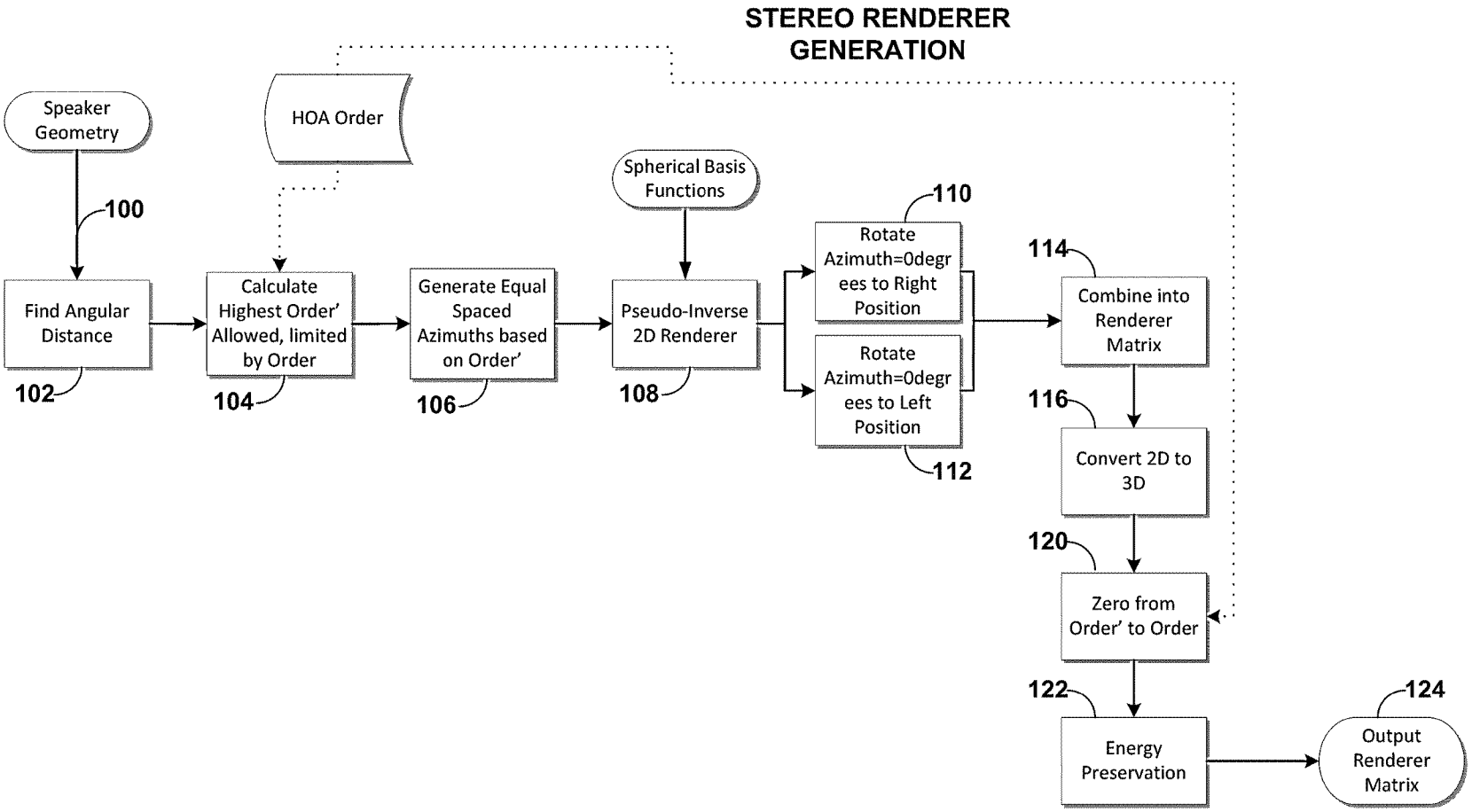
FIG. 6 is a flow diagram illustrating exemplary operation of the stereo renderer generation unit shown in the example of FIG. 4.

FIG. 6 is a flow diagram illustrating exemplary operation of the stereo renderer generation unit 48A shown in the example of FIG. 4. In the example of FIG. 6, the stereo renderer generation unit 48A may receive the local speaker geometry information 41 (100) and then determine angular distances between the speakers relative to a listener position in what may be considered as the "sweet spot" for a given speaker geometry (102). The stereo renderer generation unit 48A may then calculate a highest allowed order, limited by the HOA/SHC order of the spherical harmonic coefficients (104). The stereo renderer generation unit 48A may next generate equal spaced azimuths based on the determined allowed order (106).

The stereo renderer generation unit 48A may then sample the spherical basis functions at the locations of virtual or real speakers forming the two dimensional (2D) renderer. The stereo renderer generation unit 48A may then perform the pseudo-inverse (understood in the context of matrix mathematics) of this 2D renderer (108). Mathematically, this 2D renderer may be represented by the following $$\text{matrix}\begin{bmatrix} h_0^{(2)}(kr_1)Y_0^{0*}(\theta_1,\varphi_1) & h_0^{(2)}(kr_2)Y_0^{0*}(\theta_2,\varphi_2) & \dots \\ h_1^{(2)}(kr_1)Y_1^{1*}(\theta_1,\varphi_1). & \vdots & \dots \\ \vdots & \vdots & \dots \\ \vdots & \vdots & \dots \\ \vdots & \vdots & \dots \end{bmatrix}.$$

The size of this matrix may be V rows by $(n+1)^2$, wherein V denotes the number of virtual speakers and n denotes the SHC order. $h_n^{(2)}(\bullet)$ is the spherical Hankel function (of the second kind) of order n. $Y_n^m(\theta_r,\phi_r)$ are the spherical harmonic basis functions of order n and suborder m. $\{\theta_r,\phi_r\}$ is a point of reference (or observation point) in terms of spherical coordinates.

The stereo renderer generation unit 48A may then rotate the azimuth to the right position and to the left position generating two different 2D renderers (110, 112) and then combines them into a 2D renderer matrix (114). The stereo renderer generation unit 48A may then convert this 2D renderer matrix to a 3D renderer matrix (116) and zero pad the difference between the allowed order (denoted as order' in the example of FIG. 6) and the order, n (120). The stereo renderer generation unit 48A may then perform energy preservation with respect to the 3D renderer matrix (122), outputting this 3D renderer matrix (124).

In this way, the techniques may enable the stereo renderer generation unit 48A to generate a stereo rendering matrix based on the SHC order and angular distance between the left and right speaker positions. The stereo renderer generation unit 48A may then rotate the front position of the rendering matrix to match the left and then right speaker positions and then combine these left and right matrixes to form the final rendering matrix.

Figure 7:
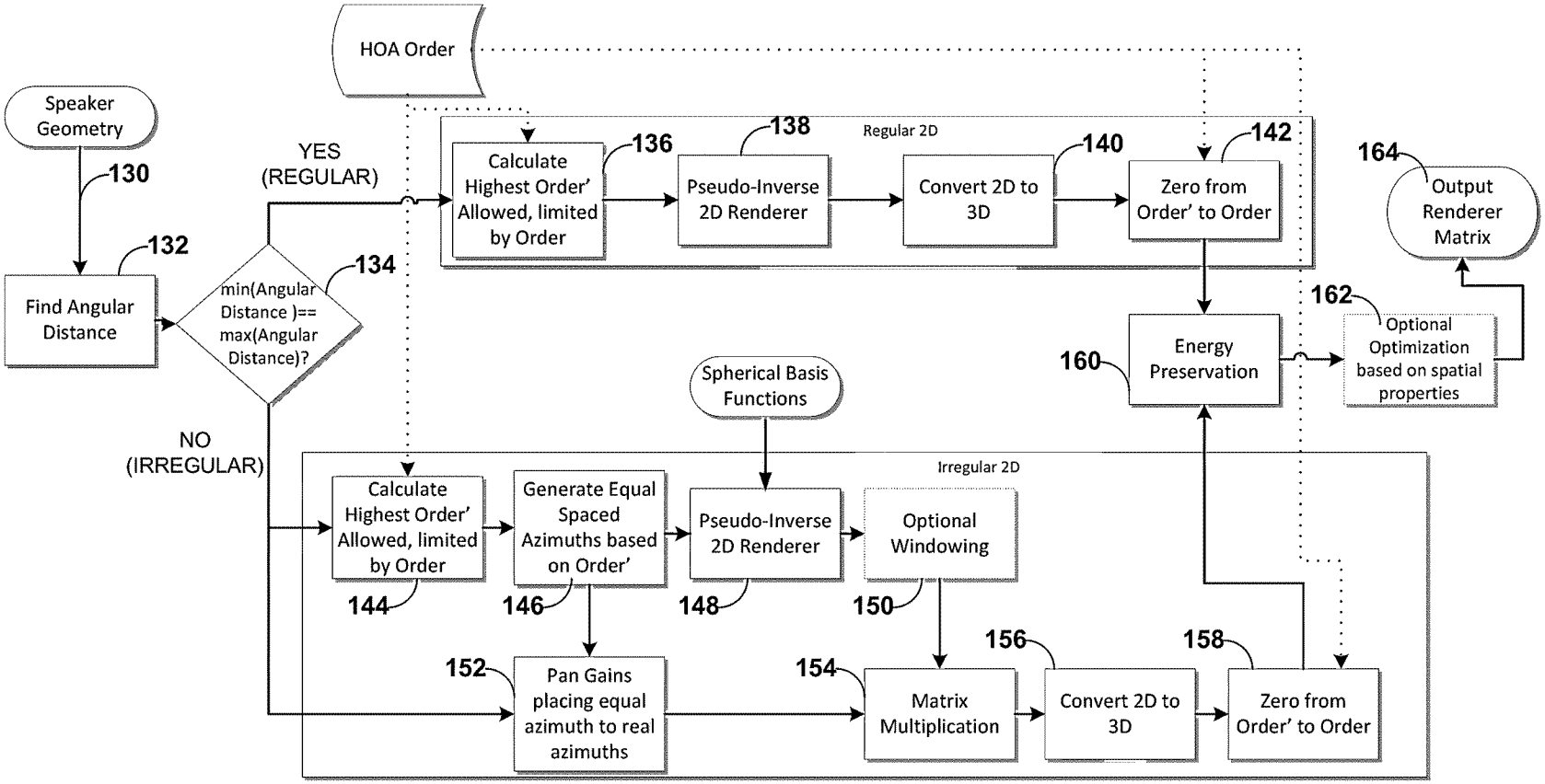
FIG. 7 is a flow diagram illustrating exemplary operation of the horizontal renderer generation unit shown in the example of FIG. 4.

FIG. 7 is a flow diagram illustrating exemplary operation of the horizontal renderer generation unit 48B shown in the example of FIG. 4. In the example of FIG. 7, the horizontal renderer generation unit 48B may receive the local speaker geometry information 41 (130) and then find angular distances between the speakers relative to a listener position in what may be considered as the "sweet spot" for a given speaker geometry (132). The horizontal renderer generation unit 48B may then compute the minimum angular distance and the maximum angular distance, comparing the minimum angular distance to the maximum angular distance (134). When the minimum angular distance is equal (or approximately equal within some angular threshold), the horizontal renderer generation unit 48B determines that the local speaker geometry is regular. When the minimum angular distance is not equal (or approximately equal within some angular threshold) to the maximum angular distance, the horizontal renderer generation unit 48B may determine that the local speaker geometry is irregular.

Considering first when the local speaker geometry is determined to be regular, the horizontal renderer generation unit 48B may calculate a highest allowed order, limited by the HOA/SHC order of the spherical harmonic coefficients, as describe above (136). The horizontal renderer generation unit 48B may next generate the pseudo-inverse of the 2D renderer (138), convert this pseudo-inverse of the 2D renderer to a 3D renderer (140), and zero pad the 3D renderer (142).

Considering next when the local speaker geometry is determined to be irregular, the horizontal renderer generation unit 48B may calculate the highest allowed order, limited by the HOA/SHC order of the spherical harmonic coefficients, as describe above (144). The horizontal renderer generation unit 48B may then generate equal spaced azimuths based on the allowed order (146) to generate a 2D renderer. The horizontal renderer generation unit 48B may perform a pseudo inverse of the 2D renderer (148), and perform an optional windowing operation (150). In some instances, the horizontal renderer generation unit 48B may not perform the windowing operation. In any event, the horizontal renderer generation unit 48B may also pan gains placing equal azimuth to real azimuths (of the irregular speaker geometry, 152) and perform a matrix multiplication of the pseudo-inverse 2D renderer by the panned gains (154). Mathematically, the panning gain matrix may represent a vector base amplitude panning (VBAP) matrix of size R×V that perform VBAP, where V again represents the number of virtual speakers and the R represents the number of real speakers. The VBAP matrix may be specified as follows:

$$\begin{bmatrix} VBAP \\ MATRIX^{-1} \\ RxV \end{bmatrix}.$$

The multiplication may be expressed as follows:

$$\begin{bmatrix} VBAP \\ MATRIX^{-1} \\ RxV \end{bmatrix} \begin{bmatrix} D^{-1} \\ Vx(n+1)^2 \end{bmatrix}.$$

The horizontal renderer generation unit 48B may then convert the output of the matrix multiplication, which is a 2D renderer, to a 3D renderer (156) and then zero pad the 3D renderer, again as described above (158).

Although described above as performing a particular type of panning to map the virtual speakers to the real speakers, the techniques may be performed with respect to any way by which to map virtual speakers to real speakers. As a result, the matrix may be denoted as a "virtual-to-real speaker mapping matrix" having a size of R×V. The multiplication may therefore be expressed more generally as:

$$\begin{bmatrix} \text{Virtual_to_Real_} \\ \text{Speaker_Mapping_Matrix}^{-1} \\ RxV \end{bmatrix} \begin{bmatrix} D^{-1} \\ Vx(n+1)^2 \end{bmatrix}.$$

This Virtual_to_Real_Speaker_Mapping_Matrix may represent any panning or other matrix that may map virtual speakers to real speakers, including include one or more of the matrices for performing vector-base amplitude panning (VBAP), one or more of the matrices for performing distance based amplitude panning (DBAP), one or more of the matrices for performing simple panning, one or more of the matrices for performing near field compensation (NFC) filtering and/or one or more of the matrices for performing wave field synthesis.

Whether a regular 3D renderer or an irregular 3D renderer is generated, the horizontal renderer generation unit 48B may perform energy preservation with respect to the regular 3D renderer or the irregular 3D renderer (160). In some examples but not all, the horizontal renderer generation unit 48B may perform an optimization based on spatial properties of the 3D renderer (162), outputting this optimized 3D or non-optimized 3D renderer (164).

In the sub-category of horizontal, the system may therefore generally detects whether the geometry of speakers is regularly spaced or irregular and then creates a rendering matrix based on the pseudo-inverse or the AllRAD approach. The AllRAD approach is discussed in more detail in a paper by Franz Zotter et al., entitled "Comparison of energy-preserving and all-round Ambisonic decoders," presented during the AIA-DAGA in Merano, 18-21 Mar. 2013. In the stereo sub-category, a rendering matrix is generated by creating a renderer matrix for a regular horizontal based on the HOA order and angular distance between the left and right speaker positions. The front position of the rendering matrix is then rotated to match the left and then right speaker positions and then combined to form the final rendering matrix.

Figure 8A:
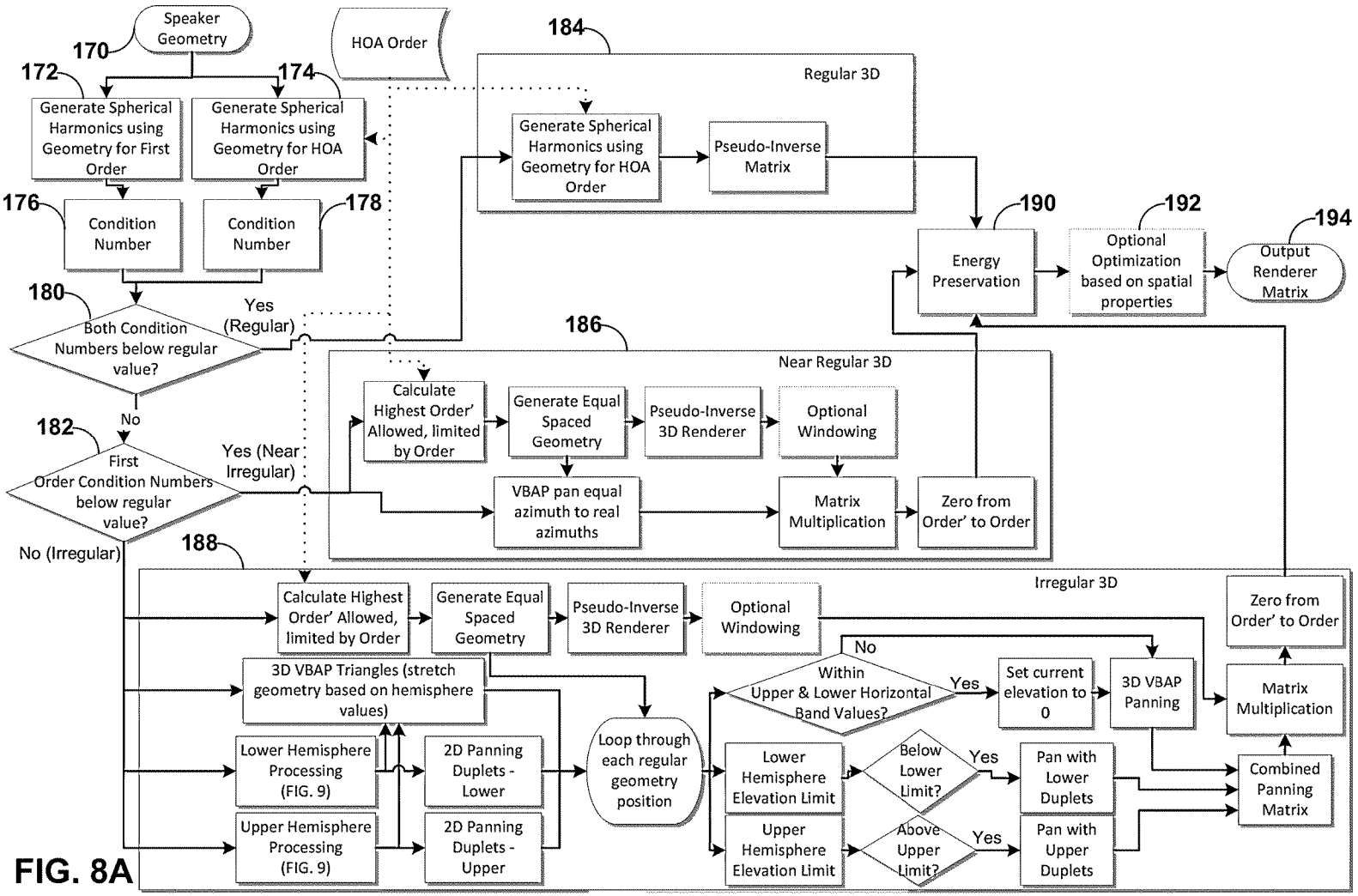
FIGS. 8A and 8B are flow diagrams illustrating exemplary operation of the 3D renderer generation unit shown in the example of FIG. 4.
Figure 8B:
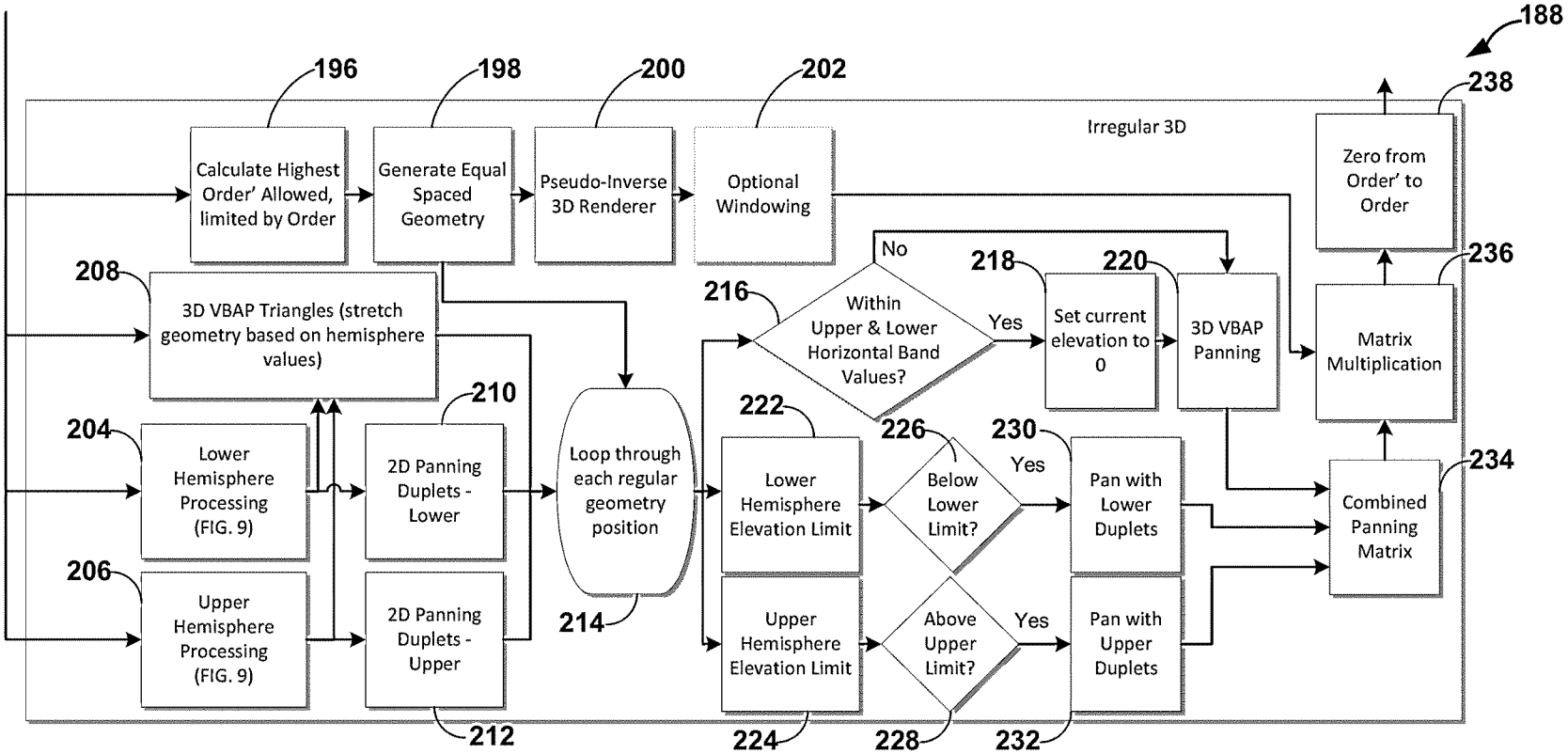

FIG. 8A-8B are flow diagrams illustrating exemplary operation of the 3D renderer generation unit 48C shown in the example of FIG. 4. In the example of FIG. 8A, the 3D renderer generation unit 48C may receive the local speaker geometry information 41 (170) and then determine spherical harmonics basis functions using the geometry of the first order and the geometry of the HOA/SHC order, n (172, 174). The 3D renderer generation unit 48C may then determine condition numbers for both the first order and less basis functions and those basis function associated with spherical basis functions greater than an order of one but less than or equal to n (176, 178). The 3D renderer generation unit 48C then compares both of the condition values to a so-called "regular value" (180), which may represent a threshold having a value of, in some examples, 1.05.

When both of the condition values are below the regular value, the 3D renderer generation unit 48C may determine that the local speaker geometry is regular (symmetrical in some sense from left to right and front to back with equally spaced speakers). When both of the condition values are not below or less than the regular value, the 3D renderer generation unit 48C may compare the condition value computed from the first order and less spherical basis functions to the regular value (182). When this first order or less condition number is less than the regular value ("YES" 182), the 3D renderer generation unit 48C determines that the local speaker geometry is nearly regular (or, as shown in the example of FIG. 8, "near regular"). When this first order or less condition number is not below the regular value ("NO" 182), the 3D renderer generation unit 48C determines that the local geometry is irregular.

When the local speaker geometry is determined to be regular, the 3D renderer generation unit 48C determines the 3D rendering matrix in a manner similar to that described above with respect to the regular 3D matrix determination set forth with respect to the example of FIG. 7, except that the 3D renderer generation unit 48C generates this matrix for multiple horizontal planes of speakers (184). When the local speaker geometry is determined to be near regular, the 3D renderer generation unit 48C determines the 3D rendering matrix in a manner similar to that described above with respect to the irregular 2D matrix determination set forth with respect to the example of FIG. 7, except that the 3D renderer generation unit 48C generates this matrix for multiple horizontal planes of speakers (186). When the local speaker geometry is determined to be irregular, the 3D renderer generation unit 48C determines the 3D rendering matrix in a manner similar to that described in U.S. Provisional Application 61/762,302, entitled "PERFORMING 2D AND/OR 3D PANNING WITH RESPECT TO HIERARCHICAL SETS OF ELEMENTS," except for slight modification to accommodate the more general nature of this determination (in that the techniques of this disclosure not limited to 22.2 speaker geometries as provided by way of example in this provisional application, 188).

Regardless of whether a regular, near regular or irregular 3D rendering matrix is generated, the 3D renderer generation unit 48C performs energy preservation with respect to the generated matrix (190) followed by, in some instances, optimizing this 3D rendering matrix based on spatial properties of the 3D rendering matrix (192). The 3D renderer generation unit 48C may then output this renderer as renderer 34 (194).

As a result, in the three-dimensional case, the system may detect a regular (using pseudo-inverse), a near regular (that is regular at first order, but not the HOA order, and uses the AllRAD method) or finally an irregular (this is based on the above referenced U.S. Provisional Application 61/762,302, but implemented as a potentially more general approach). The three-dimensional irregular process 188 may generate, where appropriate, 3D-VBAP triangulation for areas covered by speakers, high and low panning rings at the top bottom, a horizontal band, stretch factors etc. to create an enveloping renderer for irregular three-dimensional listening. All of the foregoing options may use energy preservation so that on the fly switching between geometries have the same perceived energy. Most irregular or near irregular options use an optional spherical harmonic windowing.

FIG. 8B is a flow diagram illustrating operation of the 3D renderer determination unit 48C in determining a 3D renderer for playback of audio content via an irregular 3D local speaker geometry. As shown in the example of FIG. 8B, the 3D renderer determination unit 48C may calculate the highest allowed order, limited by the HOA/SHC order of the spherical harmonic coefficients, as describe above (196). The 3D renderer generation unit 48C may then generate equal spaced azimuths based on the allowed order (198) to generate a 3D renderer. The 3D renderer generation unit 48C may perform a pseudo inverse of the 3D renderer (200), and perform an optional windowing operation (202). In some instances, the 3D renderer generation unit 48C may not perform the windowing operation The 3D renderer determination unit 48C may also perform lower hemisphere processing and upper hemisphere processing as described in more detail below with respect to FIG. 9 (204, 206). The 3D renderer determination unit 48C may, when performing the lower and upper hemisphere processing, generate hemisphere data (which is described below in more detail) indicating an amount to "stretch" the angular distances between real speakers, a 2D pan limit that may specify a panning limit to limit panning to certain threshold heights, and a horizontal band amount that may specify a horizontal height band in which speakers are considered in the same horizontal plane.

The 3D renderer determination unit 48C may, in some instances, perform a 3D VBAP operation to construct 3D VBAP triangles while possibly "stretching" the local speaker geometry based on the hemisphere data from one or more of the lower hemisphere processing and the upper hemisphere processing (208). The 3D renderer determination unit 48C may stretch the real speaker angular distances within a given hemisphere to cover more space. The 3D renderer determination unit 48C may also identify 2D panning duplets for the lower hemisphere and upper hemisphere (210, 212), where these duplets identify two real speakers for each virtual speaker in the lower and upper hemisphere, respectively. The 3D renderer determination unit 48C may then loop through each regular geometry position identified when generating the equally spaced geometry, and based on the 2D panning duplets of the lower and upper hemisphere virtual speakers and the 3D VBAP triangles perform the following analysis (214).

The 3D renderer determination unit 48C may determine whether the virtual speakers are within the upper and lower horizontal band values specified in the hemisphere data for the lower and upper hemispheres (216). When the virtual speakers are within these band values ("YES" 216), the 3D renderer determination unit 48C sets the elevation for these virtual speakers to zero (218). In other words, the 3D renderer determination unit 48C may identify virtual speakers in the lower hemisphere and upper hemisphere close to the middle horizontal plane bisecting the sphere around the so-called "sweet spot" and set the location of these virtual speakers to be on this horizontal plane. After setting these virtual speaker locations to zero or when the virtual speakers are not within the upper and lower horizontal band values ("NO" 216), the 3D renderer determination unit 48C may perform 3D VBAP panning (or any other form or way by which to map virtual speakers to real speakers) to generate the horizontal plane portion of the 3D renderer used to map the virtual speakers to the real speakers along the middle horizontal plane.

The 3D renderer determination unit 48C may, when looping through each regular geometry position of the virtual speakers, may evaluate those virtual speakers in the lower hemisphere to determine whether these lower hemisphere virtual speakers are below a lower hemisphere elevation limit specified in the lower hemisphere data (222). The 3D renderer determination unit 48C may perform a similar evaluation with respect to the upper hemisphere virtual speakers to determine whether these upper hemisphere virtual speakers are above an upper hemisphere elevation limit specified in the upper hemisphere data (224). When below in the case of lower hemisphere virtual speakers or above in the case of upper hemisphere virtual speakers ("YES" 226, 228), the 3D renderer determination unit 48C may perform panning with the identified lower duplets and the upper duplets, respectively (230, 232), effectively creating what may be referred to as a panning ring that clips the elevation of the virtual speaker and pans it between the real speakers above the horizontal band of the given hemisphere.

The 3D renderer determination unit 48C may then combine the 3D VBAP panning matrix with the lower duplets panning matrix and the upper duplets panning matrix (234) and perform a matrix multiplication to matrix multiple the 3D renderer by the combined panning matrix (236). The 3D renderer determination unit 48C may then zero pad the difference between the allowed order (denoted as order' in the example of FIG. 6) and the order, n (238), outputting the irregular 3D renderer.

In this way, the techniques may enable the renderer determination unit 40 to determining an allowed order of spherical basis functions to which spherical harmonic coefficients are associated, the allowed order identifying those of the spherical harmonic coefficients that are required to be rendered, and determine the renderer based on the determined allowed order.

In some examples, the renderer determination unit 40 the allowed order identifies those of the spherical harmonic coefficients that are required to be rendered given a determined local speaker geometry of speakers used for playback of the spherical harmonic coefficients.

In some examples, the renderer determination unit 40 may, when determining the renderer, determine the renderer such that the renderer only renders those of the spherical harmonic coefficients associated with spherical basis functions having an order less than or equal to the determined allowed order.

In some examples, the renderer determination unit 40 may the allowed order is less than the maximum order N of the spherical basis functions to which the spherical harmonic coefficients are associated.

In some examples, the renderer determination unit 40 may render the spherical harmonic coefficients using the determined renderer to generate multi-channel audio data.

In some examples, the renderer determination unit 40 may determine a local speaker geometry of one or more speakers used for playback of the spherical harmonic coefficients. When determining the renderer, the renderer determination unit 40 may determine the render based on the determined allowed order and the local speaker geometry.

In some examples, the renderer determination unit 40 may, when determining the renderer based on the local speaker geometry, determine a stereo renderer to render those of the spherical harmonic coefficients of the allowed order when the local speaker geometry conforms to a stereo speaker geometry.

In some examples, the renderer determination unit 40 may, when determining the renderer based on the local speaker geometry, determine a horizontal multi-channel renderer to render those of the spherical harmonic coefficients of the allowed order when the local speaker geometry conforms to horizontal multi-channel speaker geometry having more than two speakers.

In some examples, the renderer determination unit 40 may, when determining the horizontal multi-channel renderer, determine an irregular horizontal multi-channel renderer to render those of the spherical harmonic coefficients of the allowed order when the determined local speaker geometry indicates an irregular speaker geometry.

In some examples, the renderer determination unit 40 may, when determining the horizontal multi-channel renderer, determine a regular horizontal multi-channel renderer to render those of the spherical harmonic coefficients of the allowed order when the determined local speaker geometry indicates a regular speaker geometry.

In some examples, the renderer determination unit 40 may, when determining the renderer based on the local speaker geometry, determine a three-dimensional multi-channel renderer to render those of the spherical harmonic coefficients of the allowed order when the local speaker geometry conforms a three-dimensional multi-channel speaker geometry having more than two speakers on more than one horizontal plane.

In some examples, the renderer determination unit 40 may, when determining the three-dimensional multi-channel renderer, determine an irregular three-dimensional multi-channel renderer to render those of the spherical harmonic coefficients of the allowed order when the determined local speaker geometry indicates an irregular speaker geometry.

In some examples, the renderer determination unit 40 may, when determining the three-dimensional multi-channel renderer, determine a near regular three-dimensional multi-channel renderer to render those of the spherical harmonic coefficients of the allowed order when the determined local speaker geometry indicates a near regular speaker geometry.

In some examples, the renderer determination unit 40 may, when determining the three-dimensional multi-channel renderer, determine a regular three-dimensional multi-channel renderer to render those of the spherical harmonic coefficients of the allowed order when the determined local speaker geometry indicates a regular speaker geometry.

In some examples, the renderer determination unit 40 may, when determining the local speaker geometry of the one or more speakers, receive input from a listener specifying local speaker geometry information describing the local speaker geometry.

In some examples, the renderer determination unit 40 may, when determining the local speaker geometry of the one or more speakers, receive input via a graphical user interface from a listener specifying local speaker geometry information describing the local speaker geometry.

In some examples, the renderer determination unit 40 may, when determining the local speaker geometry of the one or more speakers, automatically determine local speaker geometry information describing the local speaker geometry.

Figure 9:
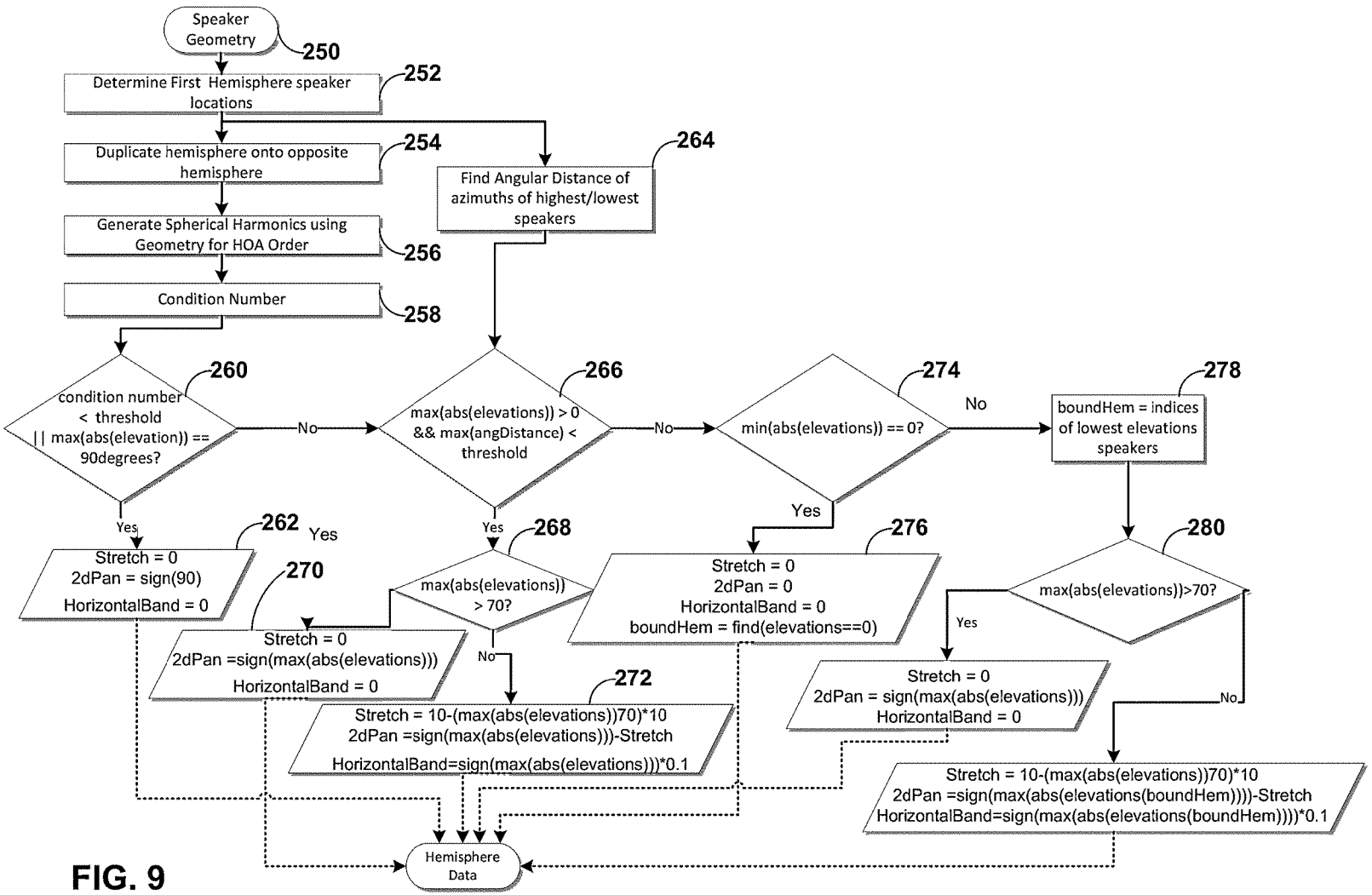
FIG. 9 is flow diagram illustrating exemplary operation of the 3D renderer generation unit shown in the example of FIG. 4 in performing lower hemisphere processing and upper hemisphere processing when determining the irregular 3D renderer.

FIG. 9 is flow diagram illustrating exemplary operation of the 3D renderer generation unit 48C shown in the example of FIG. 4 in performing lower hemisphere processing and upper hemisphere processing when determining the irregular 3D renderer. More information regarding the process shown in the example of FIG. 9 can be found in the above referenced U.S. Provisional Application 61/762,302. The process shown in the example of FIG. 9 may represent the lower or upper hemisphere processing described above with respect to FIG. 8B.

Initially, the 3D renderer determination unit 48C may receive the local speaker geometry information 41 and determine first hemisphere real speaker locations (250, 252). The 3D renderer determination unit 48C may then duplicate the first hemisphere onto the opposite hemisphere and generate spherical harmonics using the geometry for HOA order (254, 256). The 3D renderer determination unit 48C may determine the condition number (258), which may indicate the regularity (or uniformity) of the local speaker geometry. When the condition number is less than a threshold number or the maximum absolute value elevation difference between the real speakers is equal to 90 degrees ("YES" 260), the 3D renderer determination unit 48C may determine hemisphere data that includes a stretch value of zero, a 2D pan limit value of sign (90) and a horizontal band value of zero (262). As noted above, the stretch value indicates an amount to "stretch" the angular distances between real speakers, the 2D pan limit that may specify a panning limit to limit panning to certain threshold heights, and a horizontal band amount that may specify a horizontal height band in which speakers are considered in the same horizontal plane.

The 3D renderer determination unit 48C may also determine the angular distance of azimuths of the highest/lowest (depending on whether upper or lower hemisphere processing is performed) speakers (264). When the condition number is greater than a threshold number or the maximum absolute value elevation difference between the real speakers is not equal to 90 degrees ("YES" 260), the 3D renderer determination unit 48C may determine whether the maximum absolute value elevation difference is greater than zero and whether the maximum angular distance is less than a threshold angular distance (266). When the maximum absolute value elevation difference is greater than zero and the maximum angular distance is less than a threshold angular distance ("YES" 266), the 3D renderer determination unit 48C may then determine whether the maximum absolute value of the elevation is greater than 70 (268).

When the maximum absolute value of the elevation is greater than 70 ("YES" 268), the 3D renderer determination unit 48C determines hemisphere data that includes a stretch value equal to zero, a 2D pan limit equal to the sign of the maximum of the absolute value of the elevation, and a horizontal band value equal to zero (270). When the maximum absolute value of the elevation is less than or equal to 70 ("NO" 268), the 3D renderer determination unit 48C may determine hemisphere data that includes a stretch value equal to 10 minus the maximum absolute value of the elevations times 70 multiplied by 10, a 2D pan limit equal to the signed form of the maximum of the absolute value of the elevation minus the stretch value, and a horizontal band value equal to the signed form of the maximum absolute value of the elevations multiplied by 0.1 (272).

When either the maximum absolute value elevation difference is less than or equal to zero or the maximum angular distance is greater than or equal to a threshold angular distance ("NO" 266), the 3D renderer determination unit 48C may then determine whether the minimum of the absolute value of the elevations is equal to zero (274). When the minimum of the absolute value of the elevations is equal to zero ("YES" 274), the 3D renderer determination unit 48C may determine hemisphere data that includes a stretch value equal to zero, a 2D pan limit equal to zero, a horizontal band value equal to zero and a bound hemisphere value identifying indices of real speakers whose elevation are equal to zero (276). When the minimum of the absolute value of the elevations is not equal to zero ("NO" 274), the 3D renderer determination unit 48C may determine the bound hemisphere value to be equal to the indices of lowest elevation speakers (278). The 3D renderer determination unit 48C may then determine whether the maximum absolute value of the elevations is greater than 70 (280).

When the maximum absolute value of the elevations is greater than 70 ("YES" 280), the 3D renderer determination unit 48C may determine hemisphere data that includes a stretch value equal to zero, a 2D pan limit equal to the signed form of the maximum of the absolute value of the elevations, and a horizontal band value equal to zero (282). When the maximum absolute value of the elevations is less than or equal to 70 ("NO" 280), the 3D renderer determination unit 48C may determine hemisphere data that includes a stretch value equal to 10 minus the maximum absolute value of the elevations times 70 multiplied by 10, a 2D pan limit equal to the signed form of the maximum of the absolute value of the elevation minus the stretch value, and a horizontal band value equal to the signed form of the maximum absolute value of the elevations multiplied by 0.1 (282).

Figure 10:
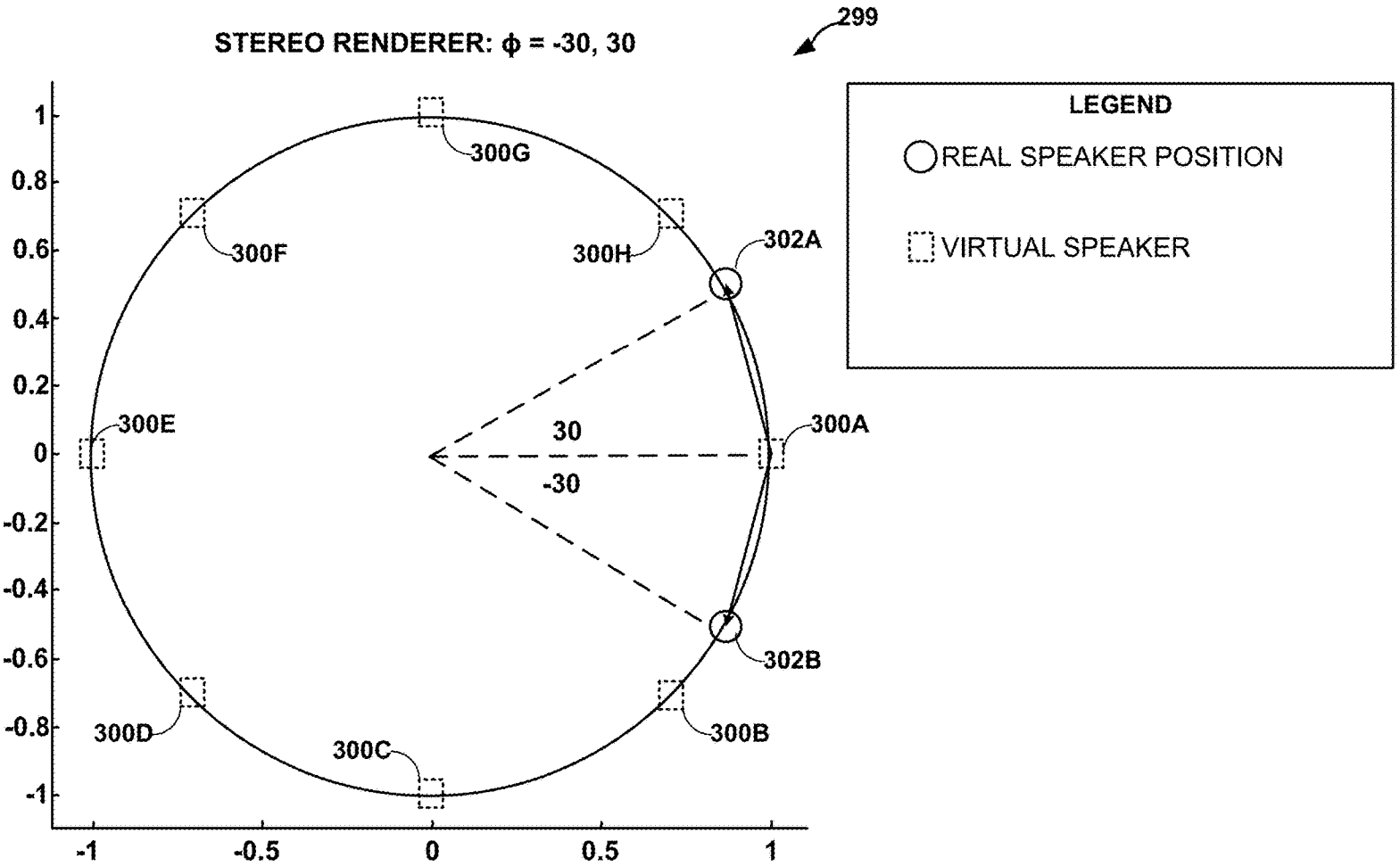
FIG. 10 is a diagram illustrating a graph 299 in unit space showing how a stereo renderer may be generated in accordance with the techniques set forth in this disclosure.

FIG. 10 is a diagram illustrating a graph 299 in unit space showing how a stereo renderer may be generated in accordance with the techniques set forth in this disclosure. As shown in the example of FIG. 10, virtual speakers 300A-300H are arranged in a uniform geometry around the circumference of the horizontal plane bisecting the unit sphere (centered around the so-called "sweet spot"). Physical speaker 302A and 302B are positioned at angular distances of 30 degrees and −30 degrees (respectively) as measured from the virtual speaker 300A. The stereo renderer determination unit 48A may determine a stereo renderer 34 that maps the virtual speaker 300A to the physical speakers 302A and 302B in the manner described above in more detail.

Figure 11:
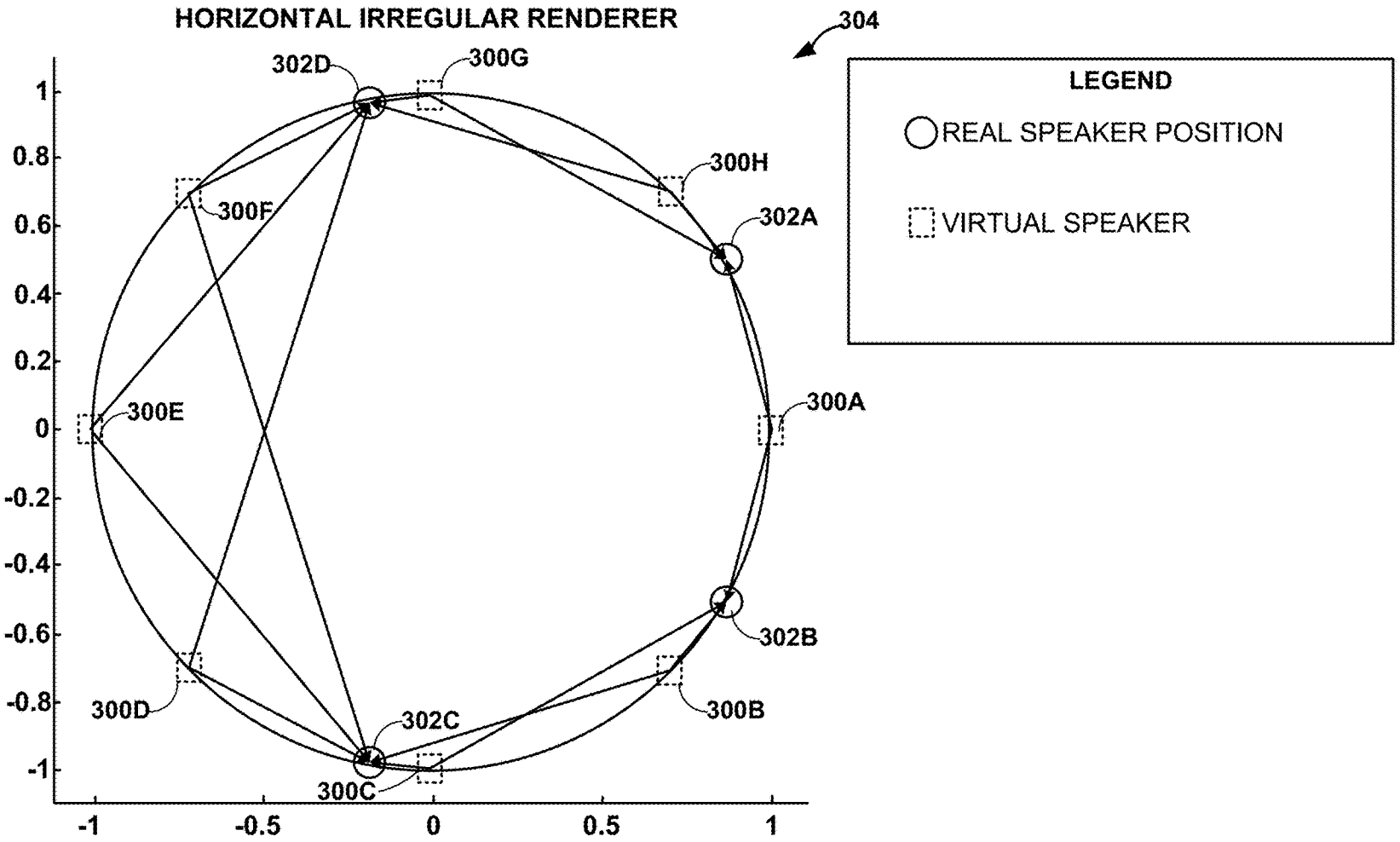
FIG. 11 is a diagram illustrating a graph 304 in unit space showing how an irregular horizontal renderer may be generated in accordance with the techniques set forth in this disclosure.

FIG. 11 is a diagram illustrating a graph 304 in unit space showing how an irregular horizontal renderer may be generated in accordance with the techniques set forth in this disclosure. As shown in the example of FIG. 11, virtual speakers 300A-300H are arranged in a uniform geometry around the circumference of the horizontal plane bisecting the unit sphere (centered around the so-called "sweet spot"). Physical speaker 302A-302D ("physical speakers 302") are positioned irregularly around the circumference of the horizontal plane. The horizontal renderer determination unit 48B may determine a irregular horizontal renderer 34 that maps the virtual speakers 300A-300H ("virtual speakers 300") to the physical speakers 302 in the manner described above in more detail.

The horizontal renderer determination unit 48B may map the virtual speakers 300 to the two of the real speakers 302 closest to each one of the virtual speakers (in terms of having the smallest angular distance). The mapping is set forth in the following table:

| VIRTUAL SPEAKER | REAL SPEAKER |
|---|---|
| 300A | 302A and 302B |
| 300B | 302B and 302C |
| 300C | 302B and 302C |
| 300D | 302C and 302D |
| 300E | 302C and 302D |
| 300F | 302C and 302D |
| 300G | 302D and 302A |
| 300H | 302D and 302A |

Figure 12A:
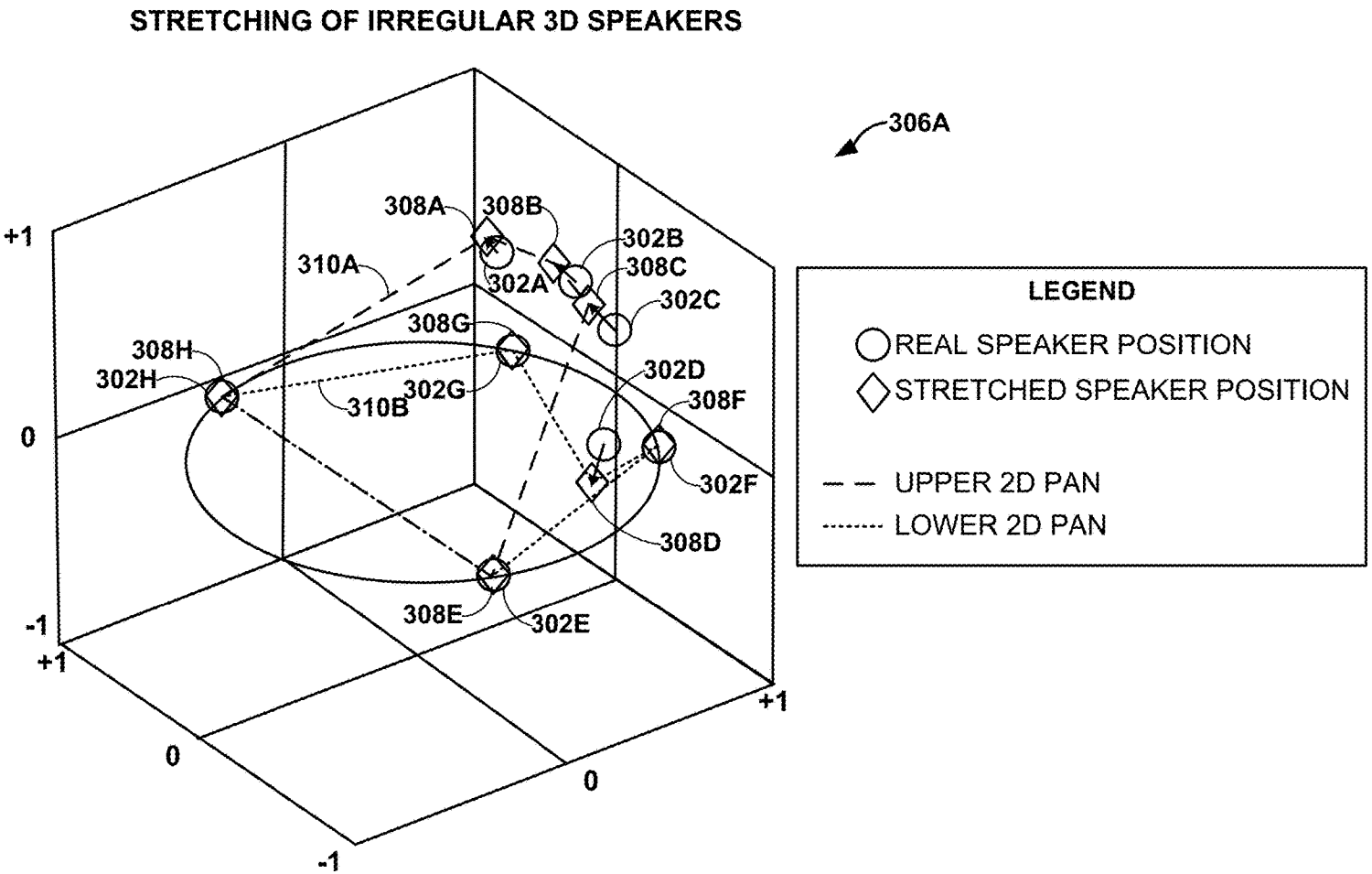
FIGS. 12A and 12B are diagrams illustrating graphs 306A and 306B showing how an irregular 3D renderer may be generated in accordance with the techniques described in this disclosure.
Figure 12B:
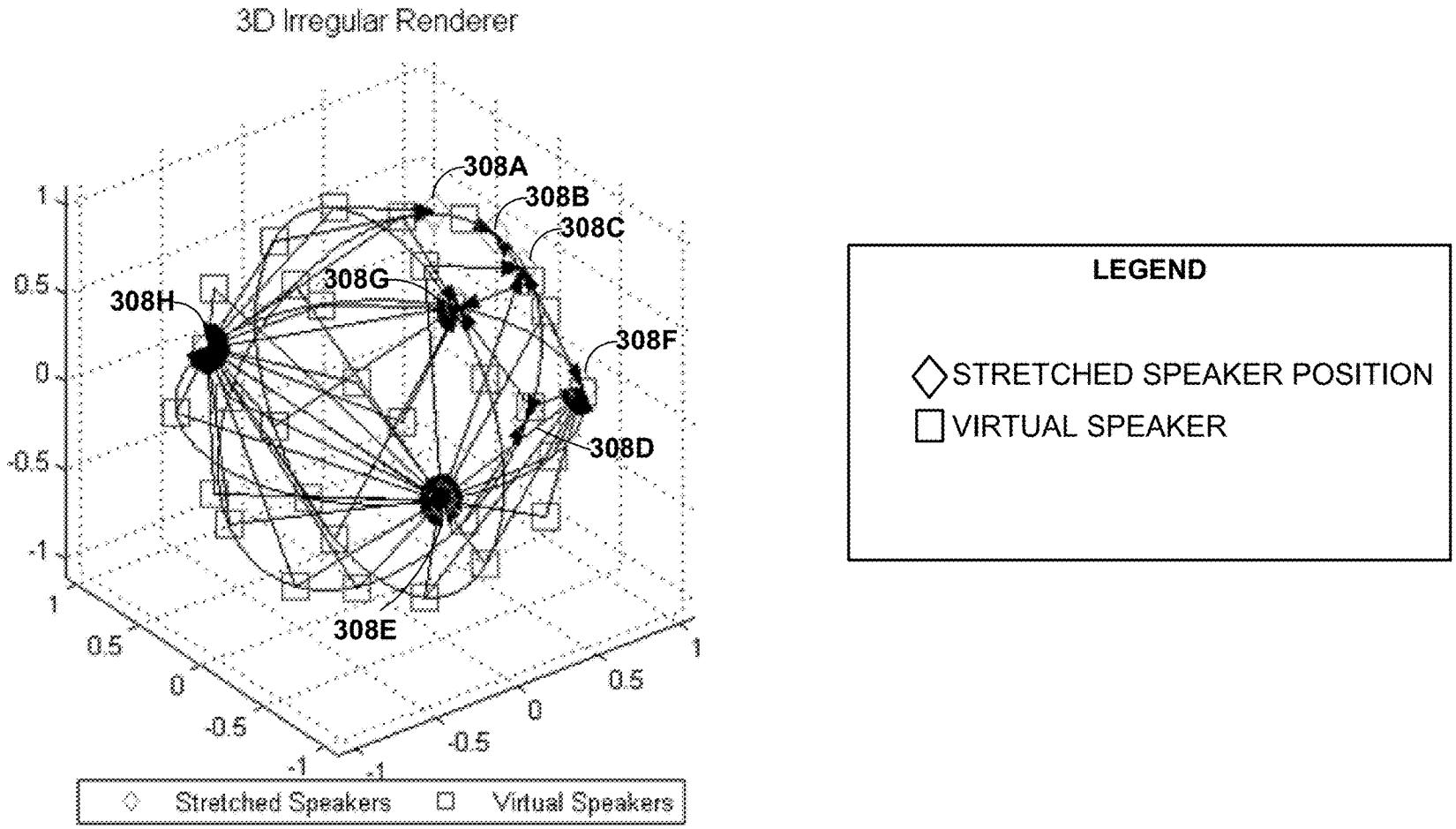

FIGS. 12A and 12B are diagrams illustrating graphs 306A and 306B showing how an irregular 3D renderer may be generated in accordance with the techniques described in this disclosure. In the example of FIG. 12A, the graph 306A includes stretched speaker locations 308A-308H ("stretched speaker locations 308"). The 3D renderer determination unit 48C may identify hemisphere data having stretched real speaker locations 308 in the manner described above with respect to the example of FIG. 9. The graph 306A also shows real speakers locations 302A-302H ("real speaker locations 302") relative to the stretched speaker locations 308, where in some instances the real speaker locations 302 are the same as the stretched speaker locations 308 and, in other instances, the real speaker locations 302 are not the same as the stretched speaker locations 308.

Graph 306A also includes upper 2D pan interpolated line 310A representative of upper 2D panning duplets and lower 2D pan interpolated line 310B representative of the lower 2D panning duplets, each of which is described above in more detail with respect to the example of FIG. 8. Briefly, the 3D renderer determination unit 48C may determine the upper 2D pan interpolated line 310A based on the upper 2D pan duplets and the lower 2D pan interpolated line 310B based on the lower 2D pan duplets. The upper 2D pan interpolated line 310A may represent the upper 2D pan matrix, while the lower 2D pan interpolated line 310B may represent the lower 2D pan matrix. These matrices, as described above, may then be combined with the 3D VBAP matrix and the regular geometry renderer to generate the irregular 3D renderer 34.

In the example of FIG. 12B, the graph 306B adds virtual speakers 300 to the graph 306A, where the virtual speakers 300 are not formally denoted in the example of FIG. 12B to avoid unnecessary confusion with the lines demonstrating the mapping of the virtual speakers 300 to the stretched speaker locations 308. Typically, as described above, the 3D renderer determination unit 48C maps each one of the virtual speakers 300 to two or more of the stretched speaker locations 308 that have the closest angular distance to the virtual speaker, similar to that shown in the horizontal examples of FIGS. 11 and 12. The irregular 3D renderer may therefore map the virtual speakers to the stretched speaker locations in the manner shown in the example of FIG. 12B.

The techniques may therefore provide for, in a first example, a device, such as the audio playback system 32, comprising means for determining a local speaker geometry, e.g., the renderer determination unit 40, of one or more speakers used for playback of spherical harmonic coefficients representative of a sound field, and means for determining, e.g., the renderer determination unit 40, a two-dimensional or three-dimensional renderer based on the local speaker geometry.

In a second example, the device of the first example may further comprise means for rendering, e.g., the audio renderer 34, the spherical harmonic coefficients using the determined two-dimensional or three-dimensional renderer to generate multi-channel audio data.

In a third example, the device of the first example, wherein the means for determining the two-dimensional or three-dimensional renderer based on the local speaker geometry may comprise means for, when the local speaker geometry conforms to a stereo speaker geometry, determining a two-dimensional stereo renderer, e.g., the stereo renderer generation unit 48A.

In a fourth example, the device of the first example, wherein the means for determining the two-dimensional or three-dimensional renderer based on the local speaker geometry comprises means for, when the local speaker geometry conforms to horizontal multi-channel speaker geometry having more than two speakers, determining, a horizontal two-dimensional multi-channel renderer, e.g., the horizontal renderer generation unit 48B.

In a fifth example, the device of the fourth example, wherein the means for determining the horizontal two-dimensional multi-channel renderer comprises means for determining an irregular horizontal two-dimensional multi-channel renderer when the determined local speaker geometry indicates an irregular speaker geometry, as described with respect to the example of FIG. 7.

In a sixth example, the device of the fourth example, wherein the means for determining the horizontal two-dimensional multi-channel renderer comprises means for determining a regular horizontal two-dimensional multi-channel renderer when the determined local speaker geometry indicates a regular speaker geometry, as described with respect to the example of FIG. 7.

In a seventh example, the device of the first example, wherein the means for determining the two-dimensional or three-dimensional renderer based on the local speaker geometry comprises means for, when the local speaker geometry conforms a three-dimensional multi-channel speaker geometry having more than two speakers on more than one horizontal plane, determining a three-dimensional multi-channel renderer, e.g., the 3D renderer generation unit 48C.

In an eighth example, the device of the seventh example, wherein the means for determining the three-dimensional multi-channel renderer comprises means for determining an irregular three-dimensional multi-channel renderer when the determined local speaker geometry indicates an irregular speaker geometry, as described above with respect to the examples of FIGS. 8A and 8B.

In a ninth example, the device of the seventh example, wherein the means for determining the three-dimensional multi-channel renderer comprises means for determining a near regular three-dimensional multi-channel renderer when the determined local speaker geometry indicates a near regular speaker geometry, as described above with respect to the example of FIG. 8A.

In a tenth example, the device of the seventh example, wherein the means for determining the three-dimensional multi-channel renderer comprises means for determining a regular three-dimensional multi-channel renderer when the determined local speaker geometry indicates a regular speaker geometry, as described above with respect to the example of FIG. 8A.

In an eleventh example, the device of the first example, wherein the means for determining the renderer comprises means for determining an allowed order of spherical basis functions to which the spherical harmonic coefficients are associated, the allowed order identifying those of the spherical harmonic coefficients that are required to be rendered given the determined local speaker geometry, and means for determining the renderer based on the determined allowed order, as described above with respect to the examples of FIGS. 5-8B.

In a twelfth example, the device of the first example, wherein the means for determining the two-dimensional or three-dimensional renderer comprises means for determining an allowed order of spherical basis functions to which the spherical harmonic coefficients are associated, the allowed order identifying those of the spherical harmonic coefficients that are required to be rendered given the determined local speaker geometry; and means for determining the two-dimensional or three-dimensional renderer such that the two-dimensional or three-dimensional renderer only renders those of the spherical harmonic coefficients associated with spherical basis functions having an order less than or equal to the determined allowed order, as described above with respect to the examples of FIGS. 5-8B.

In a thirteenth example, the device of the first example, wherein the means for determining the local speaker geometry of the one or more speakers comprises means for receiving input from a listener specifying local speaker geometry information describing the local speaker geometry.

In a fourteenth example, the device of the first example, wherein determining the two-dimensional or three-dimensional renderer based on the local speaker geometry comprises, when the local speaker geometry conforms to a mono speaker geometry, determining a mono renderer, e.g., the mono renderer determination unit 48D.

Figure 13A:
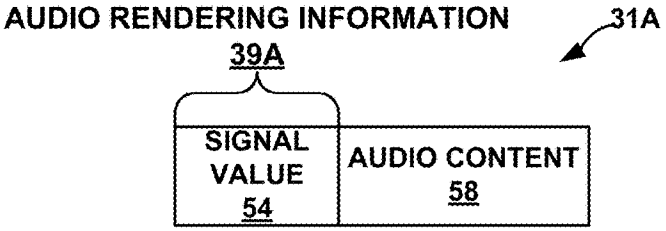
FIGS. 13A-13D illustrate a bitstream formed in accordance with various aspects of the techniques described in this disclosure.

FIGS. 13A-13D are diagram illustrating bitstreams 31A-31D formed in accordance with the techniques described in this disclosure. In the example of FIG. 13A, bitstream 31A may represent one example of bitstream 31 shown in the example of FIG. 3. The bitstream 31A includes audio rendering information 39A that includes one or more bits defining a signal value 54. This signal value 54 may represent any combination of the below described types of information. The bitstream 31A also includes audio content 58, which may represent one example of the audio content 51.

Figure 13B:
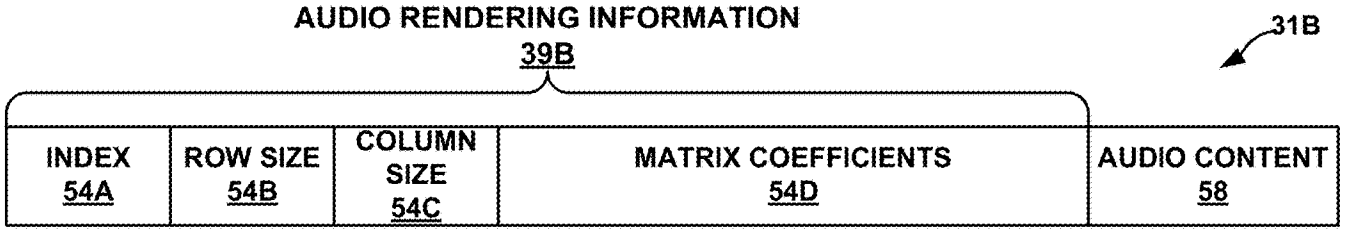

In the example of FIG. 13B, the bitstream 31B may be similar to the bitstream 31A where the signal value 54 comprises an index 54A, one or more bits defining a row size 54B of the signaled matrix, one or more bits defining a column size 54C of the signaled matrix, and matrix coefficients 54D. The index 54A may be defined using two to five bits, while each of row size 54B and column size 54C may be defined using two to sixteen bits.

The extraction device 38 may extract the index 54A and determine whether the index signals that the matrix is included in the bitstream 31B (where certain index values, such as 0000 or 1111, may signal that the matrix is explicitly specified in bitstream 31B). In the example of FIG. 13B, the bitstream 31B includes an index 54A signaling that the matrix is explicitly specified in the bitstream 31B. As a result, the extraction device 38 may extract the row size 54B and the column size 54C. The extraction device 38 may be configured to compute the number of bits to parse that represent matrix coefficients as a function of the row size 54B, the column size 54C and a signaled (not shown in FIG. 13A) or implicit bit size of each matrix coefficient. Using the determined number of bits, the extraction device 38 may extract the matrix coefficients 54D, which the audio playback device 24 may use to configure one of the audio renderers 34 as described above. While shown as signaling the audio rendering information 39B a single time in the bitstream 31B, the audio rendering information 39B may be signaled multiple times in bitstream 31B or at least partially or fully in a separate out-of-band channel (as optional data in some instances).

Figure 13D:
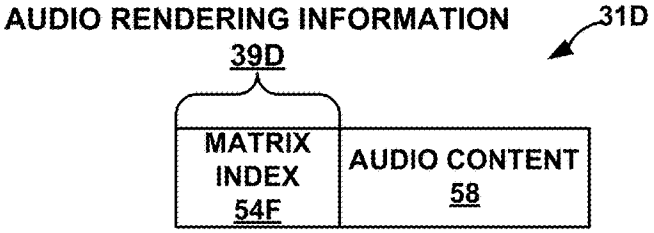
Figure 13C:
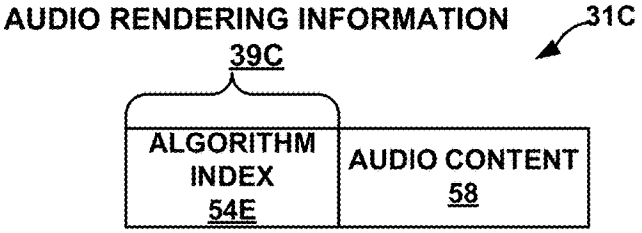

In the example of FIG. 13C, the bitstream 31C may represent one example of bitstream 31 shown in the example of FIG. 3 above. The bitstream 31C includes the audio rendering information 39C that includes a signal value 54, which in this example specifies an algorithm index 54E. The bitstream 31C also includes audio content 58. The algorithm index 54E may be defined using two to five bits, as noted above, where this algorithm index 54E may identify a rendering algorithm to be used when rendering the audio content 58.

The extraction device 38 may extract the algorithm index 50E and determine whether the algorithm index 54E signals that the matrix are included in the bitstream 31C (where certain index values, such as 0000 or 1111, may signal that the matrix is explicitly specified in bitstream 31C). In the example of FIG. 8C, the bitstream 31C includes the algorithm index 54E signaling that the matrix is not explicitly specified in bitstream 31C. As a result, the extraction device 38 forwards the algorithm index 54E to audio playback device, which selects the corresponding one (if available) the rendering algorithms (which are denoted as renderers 34 in the example of FIGS. 3 and 4). While shown as signaling audio rendering information 39C a single time in the bitstream 31C, in the example of FIG. 13C, audio rendering information 39C may be signaled multiple times in the bitstream 31C or at least partially or fully in a separate out-of-band channel (as optional data in some instances).

In the example of FIG. 13D, the bitstream 31C may represent one example of bitstream 31 shown in FIGS. 4, 5 and 8 above. The bitstream 31D includes the audio rendering information 39D that includes a signal value 54, which in this example specifies a matrix index 54F. The bitstream 31D also includes audio content 58. The matrix index 54F may be defined using two to five bits, as noted above, where this matrix index 54F may identify a rendering algorithm to be used when rendering the audio content 58.

The extraction device 38 may extract the matrix index 50F and determine whether the matrix index 54F signals that the matrix are included in the bitstream 31D (where certain index values, such as 0000 or 1111, may signal that the matrix is explicitly specified in bitstream 31C). In the example of FIG. 8D, the bitstream 31D includes the matrix index 54F signaling that the matrix is not explicitly specified in bitstream 31D. As a result, the extraction device 38 forwards the matrix index 54F to audio playback device, which selects the corresponding one (if available) the renderers 34. While shown as signaling audio rendering information 39D a single time in the bitstream 31D, in the example of FIG. 13D, audio rendering information 39D may be signaled multiple times in the bitstream 31D or at least partially or fully in a separate out-of-band channel (as optional data in some instances).

Figure 14A:
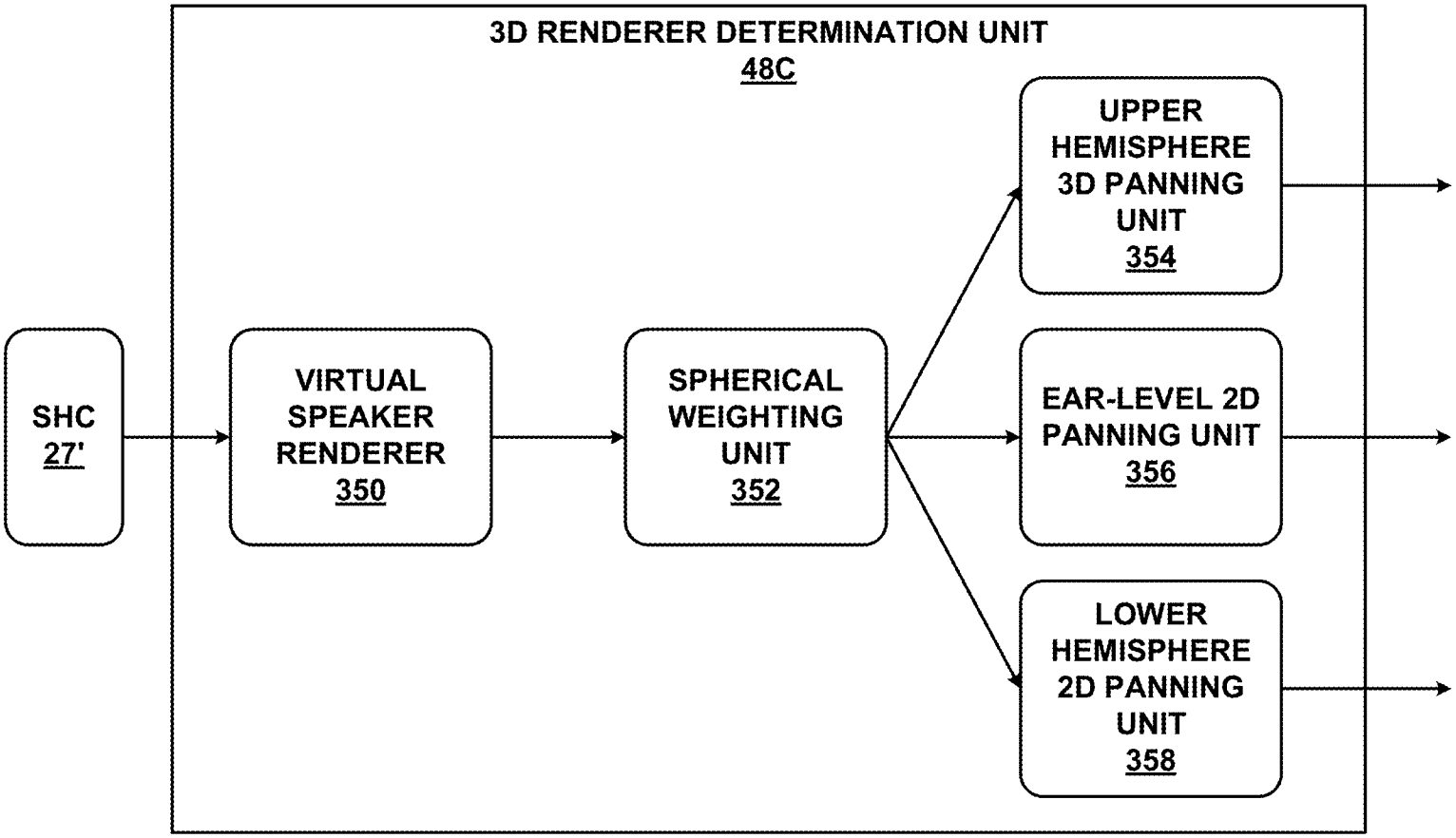
FIGS. 14A and 14B shows a 3D renderer determination unit that may implement various aspects of the techniques described in this disclosure.
Figure 14B:
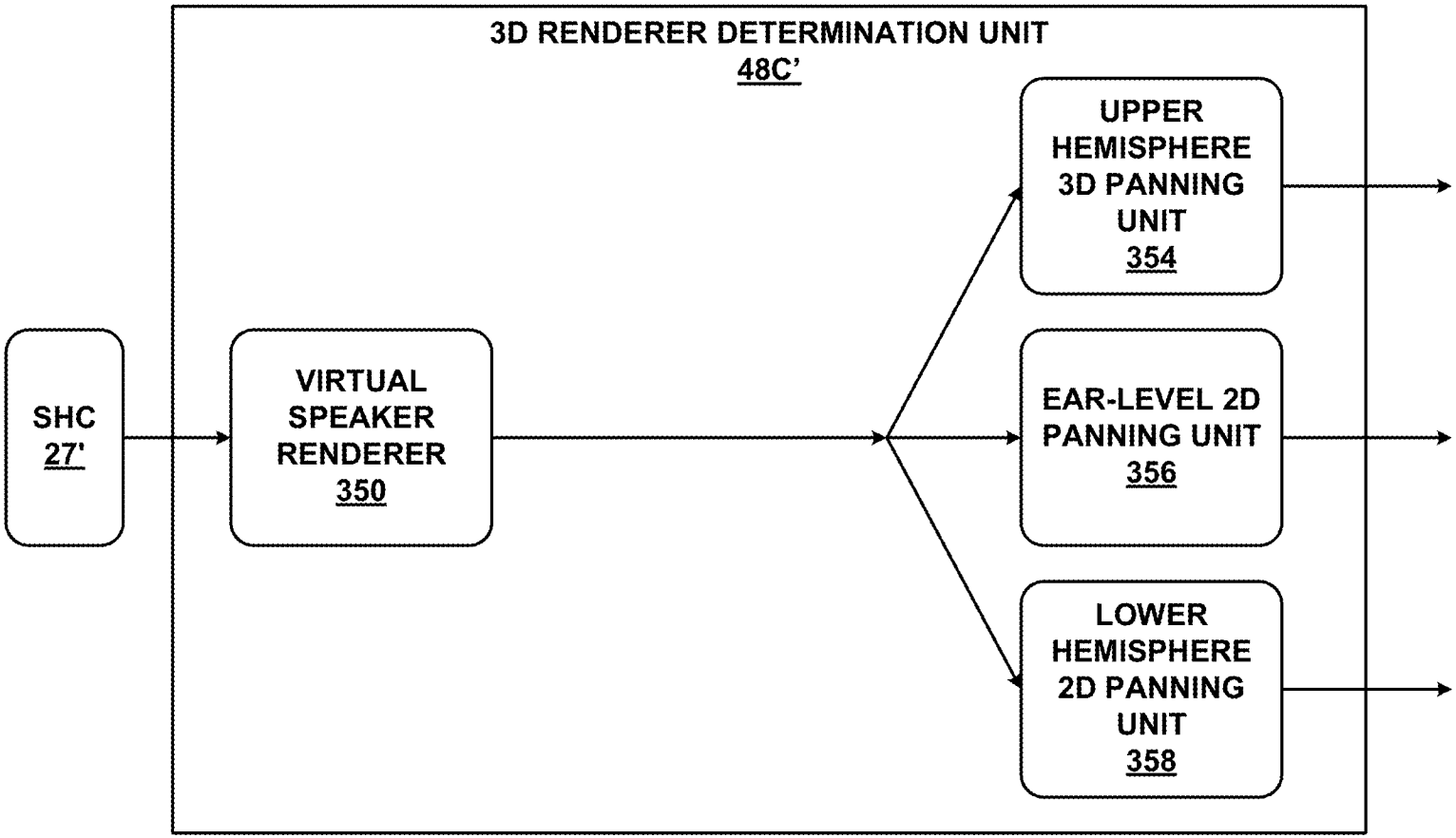

FIGS. 14A and 14B are another example of a 3D renderer determination unit 48C that may perform various aspects of the techniques described in this disclosure. That is, 3D renderer determination unit 48C may represent a unit configured to, when a virtual speaker is arranged in a sphere geometry lower than a horizontal plane bisecting the sphere geometry, project the virtual speaker to a location on the horizontal plane, and perform two dimensional panning on a hierarchical set of elements that describe a sound field when generating a first plurality of loudspeaker channel signals that reproduce the sound field such that the reproduced sound field includes at least one sound that appears to originate from the projected location of the virtual speaker.

In the example of FIG. 14A, the 3D renderer determination unit 48C may receive the SHC 27' and invoke virtual speaker renderer 350, which may represent a unit configured to perform virtual loudspeaker t-design rendering. The virtual speaker renderer 350 may render the SCH 27' and generate loudspeaker channel signals for a given number of virtual speakers (e.g., 22 or 32).

The 3D renderer determination unit 48C further includes a spherical weighting unit 352, an upper hemisphere 3D panning unit 354, an ear-level 2D panning unit 356 and a lower hemisphere 2D panning unit 358. The spherical weighting unit 352 may represent a unit configured to weight certain channels. The upper hemisphere 3D panning unit 354 represents a unit configured to perform 3D panning on the spherically weighted virtual loudspeaker channel signals to pan these signals among the various upper hemisphere physical or, in other words, real speakers. The ear-level hemisphere 2D panning unit 356 represents a unit configured to perform 2D panning on the spherically weighted virtual loudspeaker channel signals to pan these signals among the various ear-level physical or, in other words, real speakers. The lower hemisphere 2D panning unit 358 represents a unit configured to perform 2D panning on the spherically weighted virtual loudspeaker channel signals to pan these signals among the various lower hemisphere physical or, in other words, real speakers.

In the example of FIG. 14B, the 3D rendering determination unit 48C' may be similar to that shown in FIG. 14B except the 3D rendering determination unit 48C' may not perform spherical weighting or otherwise include the spherical weighting unit 352.

In any event, typically, the loudspeaker feeds are computed by assuming that each loudspeaker produces a spherical wave. In such a scenario, the pressure (as a function of frequency) at a certain position r,θ,ϕ, due to the l-th loudspeaker, is given by $$P_l(\omega, r, \theta, \varphi) = g_l(\omega) \sum_{n=0}^{\infty} j_n(kr) \sum_{m=-n}^{n} (-4\pi ik) h_n^{(2)}(kr_l) Y_n^{m*}(\theta_l, \varphi_l) Y_n^m(\theta, \varphi),$$

where $\{r_l, \theta_l, \phi_l\}$ represents the position of the l-th loudspeaker and $g_l(\omega)$ is the loudspeaker feed of the l-th speaker (in the frequency domain). The total pressure $P_t$ due to all five sneakers is thus given by $$P_t(\omega, r, \theta, \varphi) = \sum_{l=1}^{5} g_l(\omega) \sum_{n=0}^{\infty} j_n(kr) \sum_{m=-n}^{n} (-4\pi ik) h_n^{(2)}(kr_l) Y_n^{m*}(\theta_l, \varphi_l) Y_n^m(\theta, \varphi).$$

We also know that the total pressure in terms of the five SHC is given by the equation $$P_t(\omega, r, \theta, \varphi) = 4\pi \sum_{n=0}^{\infty} j_n(kr) \sum_{m=-n}^{n} A_n^m(k) Y_n^m(\theta, \varphi)$$

Equating the above two equations allows us to use a transform matrix to express the loudspeaker feeds in terms of the SHC as follows:

$$\begin{bmatrix} A_0^0(\omega) \\ A_1^1(\omega) \\ A_1^{-1}(\omega) \\ A_2^2(\omega) \\ A_2^{-2}(\omega) \end{bmatrix} = -ik \begin{bmatrix} h_0^{(2)}(kr_1) Y_0^{0*}(\theta_1, \varphi_1) & h_0^{(2)}(kr_2) Y_0^{0*}(\theta_2, \varphi_2) & \dots \\ h_1^{(2)}(kr_1) Y_1^{1*}(\theta_1, \varphi_1). & \vdots & \dots \\ \vdots & \vdots & \dots \\ \vdots & \vdots & \dots \\ \vdots & \vdots & \dots \end{bmatrix} \begin{bmatrix} g_1(\omega) \\ g_2(\omega) \\ g_3(\omega) \\ g_4(\omega) \\ g_5(\omega) \end{bmatrix}.$$

This expression shows that there is a direct relationship between the five loudspeaker feeds and the chosen SHC. The transform matrix may vary depending on, for example, which SHC were used in the subset (e.g., the basic set) and which definition of SH basis function is used. In a similar manner, a transform matrix to convert from a selected basic set to a different channel format (e.g., 7.1, 22.2) may be constructed While the transform matrix in the above expression allows a conversion from speaker feeds to the SHC, we would like the matrix to be invertible such that, starting with SHC, we can work out the five channel feeds and then, at the decoder, we can optionally convert back to the SHC (when advanced (i.e., non-legacy) renderers are present).

Various ways of manipulating the above framework to ensure invertibility of the matrix can be exploited. These include but are not limited to varying the position of the loudspeakers (e.g., adjusting the positions of one or more of the five loudspeakers of a 5.1 system such that they still adhere to the angular tolerance specified by the ITU-R BS.775-1 standard; regular spacings of the transducers, such as those adhering to the T-design, are typically well behaved), regularization techniques (e.g., frequency-dependent regularization) and various other matrix manipulation techniques that often work to ensure full rank and well-defined eigenvalues. Finally, it may be desirable to test the 5.1 rendition psycho-acoustically to ensure that after all the manipulation, the modified matrix does indeed produce correct and/or acceptable loudspeaker feeds. As long as invertibility is preserved, the inverse problem of ensuring correct decoding to the SHC is not an issue.

For some local speaker geometries (which may refer to a speaker geometry at the decoder), the way outlined above to manipulate the above framework to ensure invertibility may result in less-than-desirable audio-image quality. That is, the sound reproduction may not always result in a correct localization of sounds when compared to the audio being captured. In order to correct for this less-than-desirable image quality, the techniques may be further augmented to introduce a concept that may be referred to as "virtual speakers." Rather than require that one or more loudspeakers be repositioned or positioned in particular or defined regions of space having certain angular tolerances specified by a standard, such as the above noted ITU-R BS.775-1, the above framework may be modified to include some form of panning, such as vector base amplitude panning (VBAP), distance based amplitude panning, or other forms of panning Focusing on VBAP for purposes of illustration, VBAP may effectively introduce what may be characterized as "virtual speakers." VBAP may generally modify a feed to one or more loudspeakers so that these one or more loudspeakers effectively output sound that appears to originate from a virtual speaker at one or more of a location and angle different than at least one of the location and/or angle of the one or more loudspeakers that supports the virtual speaker.

To illustrate, the above equation for determining the loudspeaker feeds in terms of the SHC may be modified as follows:

$$\begin{bmatrix} A_0^0(\omega) \\ A_1^1(\omega) \\ A_1^{-1}(\omega) \\ \dots \\ A_{(Order+1)(Order+1)}^{-(Order+1)(Order+1)}(\omega) \end{bmatrix} = -ik \begin{bmatrix} VBAP \\ \text{MATRIX} \\ MxN \end{bmatrix} \begin{bmatrix} D \\ Nx(\text{Order}+1)^2 \end{bmatrix} \begin{bmatrix} g_1(\omega) \\ g_2(\omega) \\ g_3(\omega) \\ \dots \\ g_M(\omega) \end{bmatrix}.$$

In the above equation, the VBAP matrix is of size M rows by N columns, where M denotes the number of speakers (and would be equal to five in the equation above) and N denotes the number of virtual speakers. The VBAP matrix may be computed as a function of the vectors from the defined location of the listener to each of the positions of the speakers and the vectors from the defined location of the listener to each of the positions of the virtual speakers. The D matrix in the above equation may be of size N rows by $(\text{order}+1)^2$ columns, where the order may refer to the order of the SH functions. The D matrix may represent the following $$\text{matrix}\begin{bmatrix} h_0^{(2)}(kr_1)Y_0^{0*}(\theta_1,\varphi_1) & h_0^{(2)}(kr_2)Y_0^{0*}(\theta_2,\varphi_2) & \dots \\ h_1^{(2)}(kr_1)Y_1^{1*}(\theta_1,\varphi_1). & \vdots & \dots \\ \vdots & \vdots & \dots \\ \vdots & \vdots & \dots \\ \vdots & \vdots & \dots \end{bmatrix}.$$

In effect, the VBAP matrix is an M×N matrix providing what may be referred to as a "gain adjustment" that factors in the location of the speakers and the position of the virtual speakers. Introducing panning in this manner may result in better reproduction of the multi-channel audio that results in a better quality image when reproduced by the local speaker geometry. Moreover, by incorporating VBAP into this equation, the techniques may overcome poor speaker geometries that do not align with those specified in various standards.

In practice, the equation may be inverted and employed to transform SHC back to a multi-channel feed for a particular geometry or configuration of loudspeakers, which may be referred to as geometry B below. That is, the equation may be inverted to solve for the g matrix. The inverted equation may be as follows:

$$\begin{bmatrix} g_1(\omega) \\ g_2(\omega) \\ g_3(\omega) \\ \dots \\ g_M(\omega) \end{bmatrix} = -ik\begin{bmatrix} VBAP \\ MATRIX^{-1} \\ MxN \end{bmatrix}\begin{bmatrix} D^{-1} \\ Nx(\text{Order}+1)^2 \end{bmatrix}\begin{bmatrix} A_0^0(\omega) \\ A_1^1(\omega) \\ A_1^{-1}(\omega) \\ \dots \\ A_{(Order+1)(Order+1)}^{-(Order+1)(Order+1)}(\omega) \end{bmatrix}.$$

The g matrix may represent speaker gain for, in this example, each of the five loudspeakers in a 5.1 speaker configuration. The virtual speakers locations used in this configuration may correspond to the locations defined in a 5.1 multichannel format specification or standard. The location of the loudspeakers that may support each of these virtual speakers may be determined using any number of known audio localization techniques, many of which involve playing a tone having a particular frequency to determine a location of each loudspeaker with respect to a headend unit (such as an audio/video receiver (A/V receiver), television, gaming system, digital video disc system, or other types of headend systems). Alternatively, a user of the headend unit may manually specify the location of each of the loudspeakers. In any event, given these known locations and possible angles, the headend unit may solve for the gains, assuming an ideal configuration of virtual loudspeakers by way of VBAP.

In this respect, the techniques may enable a device or apparatus to perform a vector base amplitude panning or other form of panning on the first plurality of loudspeaker channel signals to produce a first plurality of virtual loudspeaker channel signals. These virtual loudspeaker channel signals may represent signals provided to the loudspeakers that enable these loudspeakers to produce sounds that appear to originate from the virtual loudspeakers. As a result, when performing the first transform on the first plurality of loudspeaker channel signals, the techniques may enable a device or apparatus to perform the first transform on the first plurality of virtual loudspeaker channel signals to produce the hierarchical set of elements that describes the sound field.

Moreover, the techniques may enable an apparatus to perform a second transform on the hierarchical set of elements to produce a second plurality of loudspeaker channel signals, where each of the second plurality of loudspeaker channel signals is associated with a corresponding different region of space, where the second plurality of loudspeaker channel signals comprise a second plurality of virtual loudspeaker channels and where the second plurality of virtual loudspeaker channel signals is associated with the corresponding different region of space. The techniques may, in some instances, enable a device to perform a vector base amplitude panning on the second plurality of virtual loudspeaker channel signals to produce a second plurality of loudspeaker channel signals.

While the above transformation matrix was derived from a 'mode matching' criteria, alternative transform matrices can be derived from other criteria as well, such as pressure matching, energy matching, etc. It is sufficient that a matrix can be derived that allows the transformation between the basic set (e.g., SHC subset) and traditional multichannel audio and also that after manipulation (that does not reduce the fidelity of the multichannel audio), a slightly modified matrix can also be formulated that is also invertible.

In some instances, when performing the panning described above, which may also be referred to as "3D panning" in the sense that panning is performed in three dimensional space, the above described 3D panning may introduce artifacts or otherwise result in lower quality playback of the speaker feeds. To illustrate by way of example, the 3D panning described above may be employed with respect to a 22.2 speaker geometry, which is shown in FIG. 15A and FIG. 15B.

Figure 15B:
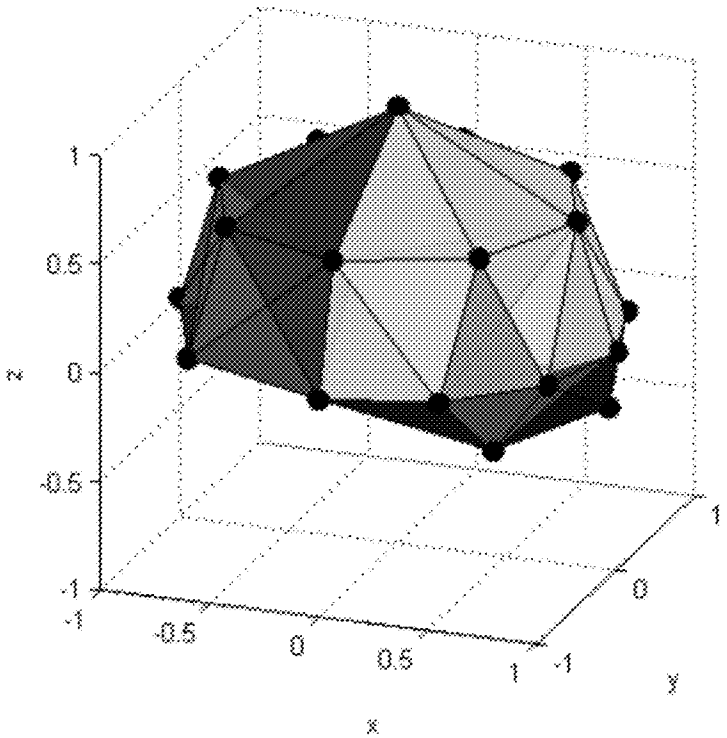
FIGS. 15A and 15B show a 22.2 speaker geometry.
Figure 15A:
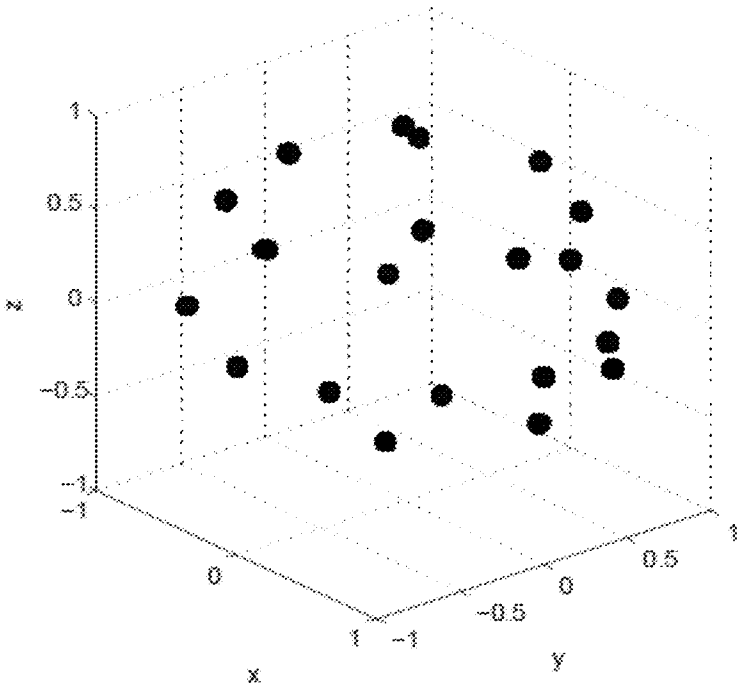

FIGS. 15A and 15B illustrate the same 22.2 speaker geometry, where the black dots in the graph shown in FIG. 15A shows the location of all loudspeakers 22 speakers (and excluding the low frequency speakers) and FIG. 15B shows the location of these same speakers but additionally defines the semi-sphere positional nature of these speakers (which blocks those speakers located behind the shaded semi-sphere). In any event, few of the actual speakers (the number of which are denoted as M above), are actually below the listener's ear in that semi-sphere, with the listener's head being positioned somewhere in the semi-sphere around the (x, y, z) point of (0, 0, 0) in the graphs of FIGS. 15A and 15B. As a result, attempting to perform 3D panning to virtualize speakers below the listener's head may be difficult, especially when trying to virtualize a 32 speaker sphere (and not a semi-sphere) geometry having virtual speakers positioned uniformly around the full sphere, as is commonly assumed when generating SHC and which is shown in the example of FIG. 12B with the positions of the virtual speakers.

According to the techniques described in this disclosure, the 3D renderer determination unit 48C shown in the example of FIG. 14A, may represent a unit to, when a virtual speaker is arranged in a sphere geometry lower than a horizontal plane bisecting the sphere geometry, project the virtual speaker to a location on the horizontal plane, and perform two dimensional panning on a hierarchical set of elements that describe a sound field when generating a first plurality of loudspeaker channel signals that reproduce the sound field such that the reproduced sound field includes at least one sound that appears to originate from the projected location of the virtual speaker.

Figure 16A:
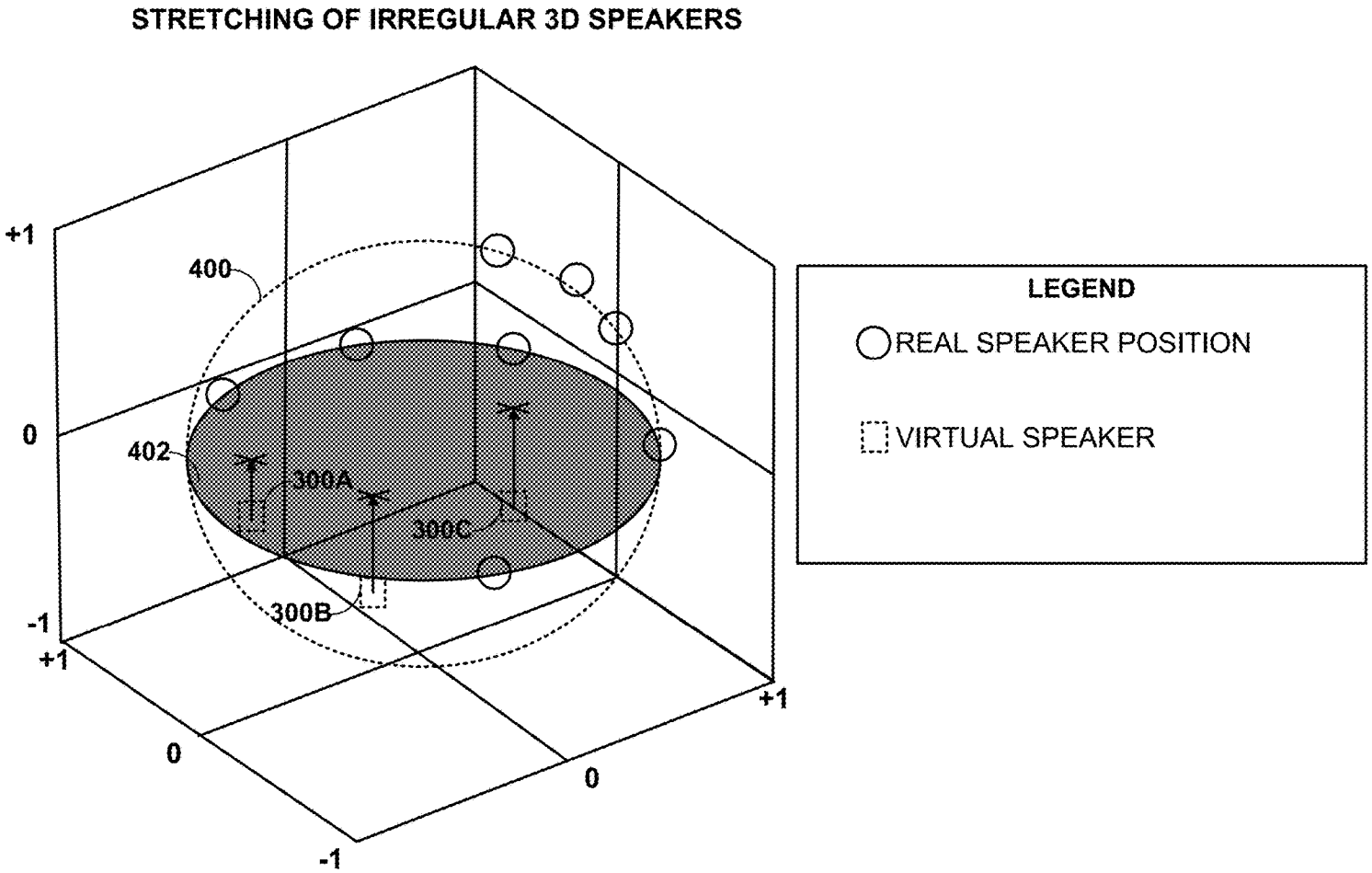
FIGS. 16A and 16B each show a virtual sphere on which virtual speakers are arranged that is segmented by a horizontal plane to which one or more of the virtual speakers are projected in accordance with various aspects of the techniques described in this disclosure.

The horizontal plane may in some instances bisects the sphere geometry into two equal parts. FIG. 16A shows a sphere 400 bisected by a horizontal plane 402 on to which virtual speakers are projected upwards in accordance with the technique described in this disclosure. The virtual speakers 300A-300C, where the lower virtual speaker 300A-300C are projected in the manner recited above onto horizontal plane 402 prior to performing two dimensional planning in the way outlined above with respect to the examples of FIGS. 14A and 14B. While described as being projected onto a horizontal plane 402 that equally bisects the sphere 400, the techniques may project the virtual speakers to any horizontal plane (e.g. elevation) within the sphere 400.

Figure 16B:
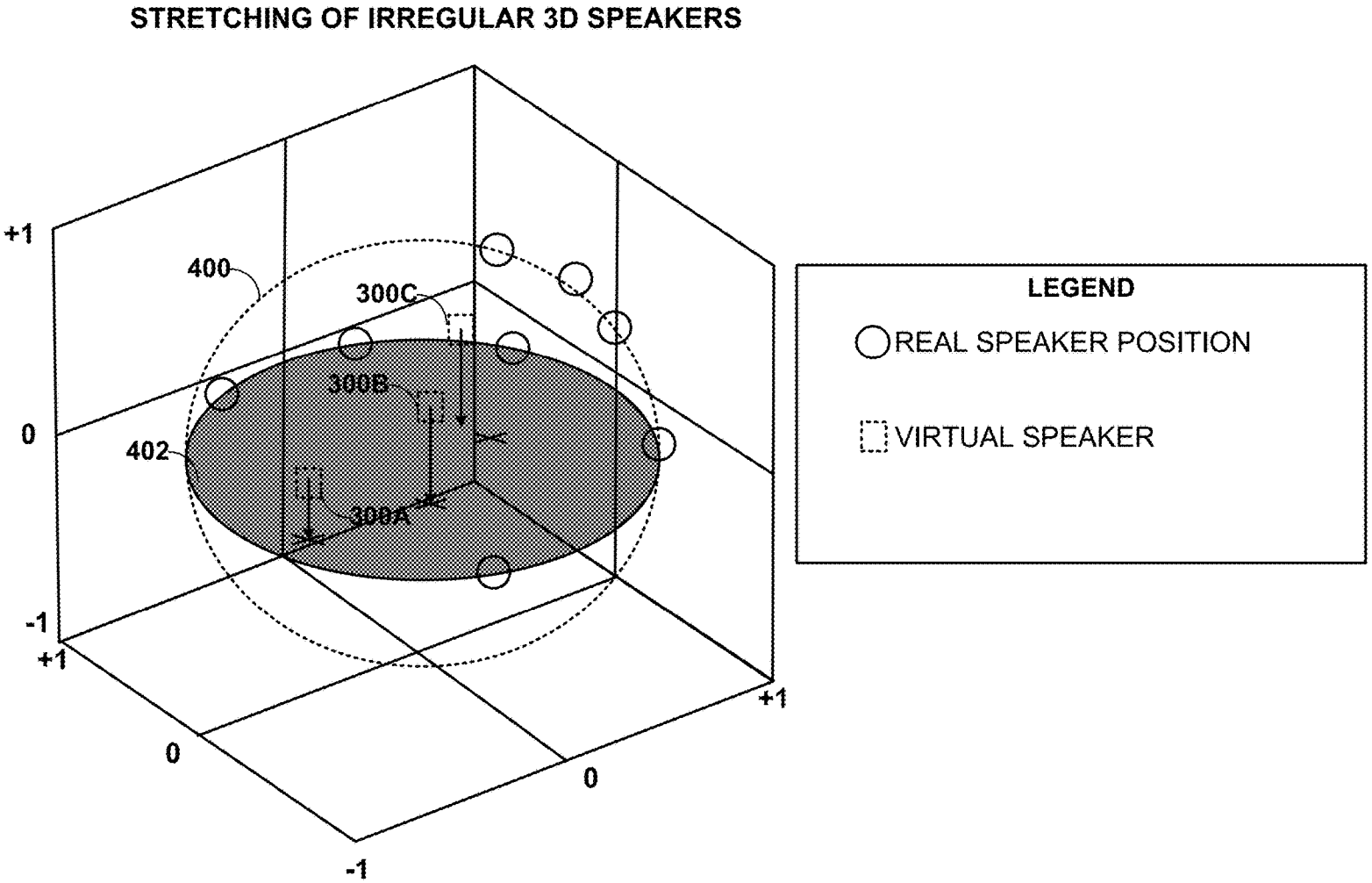

FIG. 16B shows the sphere 400 bisected by a horizontal plane 402 on to which virtual speakers are projected downward in accordance with the techniques described in this disclosure. In this example of FIG. 16B, the 3D renderer determination unit 48C may project the virtual speakers 300A-300C down to the horizontal plane 402. While described as being projected onto a horizontal plane 402 that equally bisects the sphere 400, the techniques may project the virtual speakers to any horizontal plane (e.g. elevation) within the sphere 400.

In this way, the techniques may enable the 3D renderer determination unit 48C to determine a position of one of a plurality of physical speakers relative to a position of one of a plurality of virtual speakers arranged in a geometry, and adjust the position of the one of the plurality of virtual speakers within the geometry based on the determined position.

The 3D renderer determination unit 48C may be further configured to perform a first transform in addition to the two dimensional panning on the hierarchical set of elements when generating the first plurality of loudspeaker channel signals, wherein each of the first plurality of loudspeaker channel signals is associated with a corresponding different region of space. This first transform may be reflected in the equations above as $D^{-1}$.

The 3D renderer determination unit 48C may be further configured to, when performing two dimensional panning on the hierarchical set of elements, perform two dimensional vector base amplitude panning on the hierarchical set of elements when generating the first plurality of loudspeaker channel signals.

In some instances, each of the first plurality of loudspeaker channel signals is associated with a corresponding different defined region of space. Moreover, the different defined regions of space are defined in one or more of an audio format specification and an audio format standard.

The 3D renderer determination unit 48C may also or alternatively be configured to, when a virtual speaker is arranged in a sphere geometry near a horizontal plane at or near ear level in the sphere geometry, perform two dimensional panning on a hierarchical set of elements that describe a sound field when generating a first plurality of loudspeaker channel signals that reproduce the sound field such that the reproduced sound field includes at least one sound that appears to originate from a location of the virtual speaker.

In this context, the 3D renderer determination unit 48C may be further configured to perform a first transform (which again may refer to the $D^{-1}$ transform noted above) in addition to the two dimensional panning on the hierarchical set of elements when generating the first plurality of loudspeaker channel signals, where each of the first plurality of loudspeaker channel signals is associated with a corresponding different region of space.

Moreover, the 3D renderer determination unit 48C may be further configured to, when performing two dimensional panning on the hierarchical set of elements, perform two dimensional vector base amplitude panning on the hierarchical set of elements when generating the first plurality of loudspeaker channel signals.

In some instances, each of the first plurality of loudspeaker channel signals is associated with a corresponding different defined region of space. In addition, the different defined regions of space may be defined in one or more of an audio format specification and an audio format standard.

Alternatively or in conjunction with any of the other aspect of the techniques described in this disclosure, the one or more processors of device 10 may be further configured to, when a virtual speaker is arranged in a sphere geometry above a horizontal plane bisecting the sphere geometry, perform three dimensional panning on a hierarchical set of elements when generating a first plurality of loudspeaker channel signals that describe a sound field such that the sound field includes at least one sound that appears to originate from a location of the virtual speaker.

Again, in this context, the 3D renderer determination unit 48C may be further configured to perform a first transform in addition to the three dimensional panning on the hierarchical set of elements when generating the first plurality of loudspeaker channel signals, wherein each of the first plurality of loudspeaker channel signals is associated with a corresponding different region of space.

Moreover, the 3D renderer determination unit 48C may be further configured to, when performing three dimensional panning on the hierarchical set of elements the first plurality of loudspeaker channel signals, perform three dimensional vector base amplitude panning on the hierarchical set of elements when generating the first plurality of loudspeaker channel signals. In some instances, each of the first plurality of loudspeaker channel signals is associated with a corresponding different defined region of space. Additionally, the different defined regions of space may be defined in one or more of an audio format specification and an audio format standard.

Alternatively or in conjunction with any of the other aspect of the techniques described in this disclosure, the 3D renderer determination unit 48C may further be configure to, when performing both a three dimensional panning and a two dimensional panning in the generation of a plurality of loudspeaker channel signals from a hierarchical set of elements, perform a weighting with respect to the hierarchical set of elements based on an order of each of the hierarchical set of elements.

Figure 17:
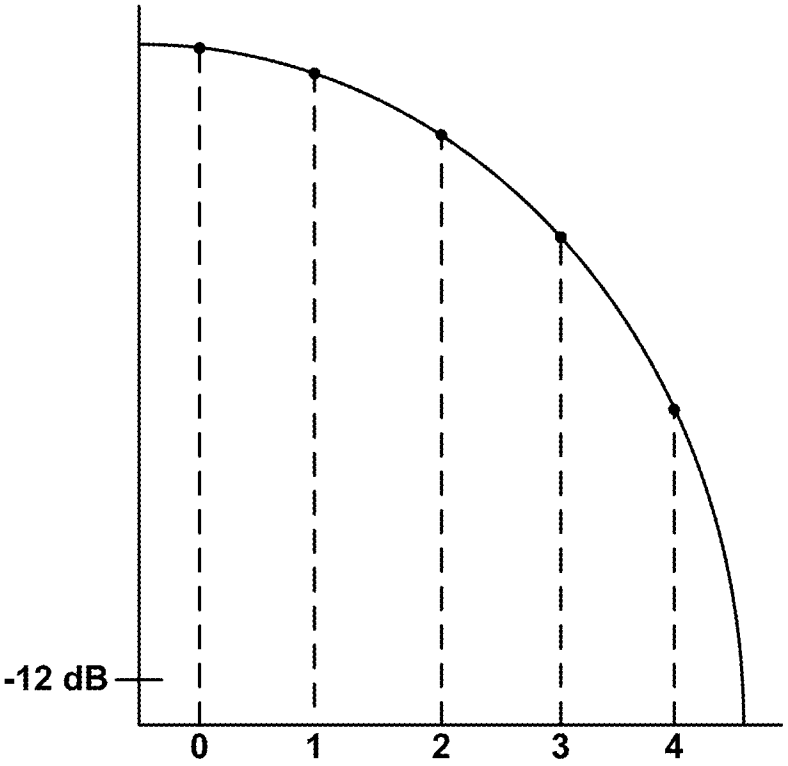
FIG. 17 shows a windowing function that may be applied to a hierarchical set of elements in accordance with various aspects of the techniques described in this disclosure.

The 3D renderer determination unit 48C may be further configure to, when performing the weighting, perform a window function with respect to the hierarchical set of elements based on the order of each of the hierarchical set of elements. This windowing function may be shown in the example of FIG. 17, where the y-axis reflects decibels and the x-axis denotes the order of the SHC. Moreover, the one or more processors of device 10 may further be configure to, when performing the weighting, perform a Kaiser Bessle window function, as one example, with respect to the hierarchical set of elements based on the order of each of the hierarchical set of elements.

These one or more processors may each represent means for perform the various functions attributed to the one or more processors. Other means may include dedicated application specific hardware, field programmable gate arrays, application specific integrated circuits or any other form of hardware dedicated or capable of executing software that may perform the various aspects either alone or in combination of the techniques described in this disclosure.

The problem identified and potentially solved by the techniques may be summarized as follows. For faithfully playback of Higher Order Ambisonics/Spherical Harmonic Coefficients surround-sound material, the arrangement of the loudspeakers may be crucial. Ideally, a three-dimensional sphere of equidistant loudspeakers may be desired. In the real world, current loudspeaker setups are typically 1) not equally distributed, 2) exist only in the upper hemisphere around and above a listener, not in the lower hemisphere below and 3) for legacy support (e.g., 5.1 speaker setup) have usually a ring of loudspeakers at the height of the ears. One strategy that may address the problem is to virtually create the ideal loudspeaker layout (in the following, called "t-design") and to project these virtual loudspeakers onto the real (non-ideally positioned) loudspeakers via the three-dimensional Vector Base Amplitude Panning (3D-VBAP) method. Even so, this may not represent an optimal solution to the problem because the projection of the virtual loudspeakers from the lower hemisphere can cause strong localization errors and other perceptual artifacts that degrades the quality of the playback.

Various aspect of the techniques described in this disclosure may overcome the deficiencies of the above outlined strategy. The techniques may provide for a different treatment of the virtual loudspeaker signals: The first aspects of the techniques may enable device 10 to orthogonally map the virtual loudspeakers coming from the lower hemisphere onto the horizontal plane and projected onto the two closest real loudspeakers using a two-dimensional panning method. As a result, the first aspect of the techniques may minimize, reduce or remove localization errors caused by wrongly projected virtual loudspeakers. Second, the virtual loudspeakers in the upper hemisphere that are at (or about) the height of the ears may also projected to the two closest loudspeakers using a two-dimensional panning method in accordance with the second aspects of the techniques described in this disclosure. The reason behind this second modification may be that humans may not be as accurate in the perception of elevated sound sources, compared to the perception of the azimuthal direction. Although VBAP is generally known to be accurate in the creation of azimuthal direction of a virtual sound source, it is relatively inaccurate in the creation of elevated sounds—often the perceived virtual sounds sources are perceived with a higher elevation than intended. The second aspect of the techniques avoids using 3D-VBAP in spatial area which would not benefit from it, and may even cause a degraded quality.

The third aspect of the techniques is that all the remaining virtual loudspeakers of the upper hemisphere above ear level are projected using a conventional three-dimensional panning method. In some instances, a fourth aspect of the techniques may be performed where all the Higher Order Ambisonics/Spherical Harmonic Coefficients surround-sound material are weighted using a weighting function as a function of the spherical harmonics order to increase a smoother spatial reproduction of the material. This has been shown to be potentially beneficial for matching the energy of the 2D and the 3D panned virtual loudspeakers.

While shown as performing each aspect of the techniques described in this disclosure, the 3D renderer determination unit 48C may perform any combination of the aspects described in this disclosure, performing one or more of the four aspects. In some instances, a different device that generates spherical harmonic coefficients may perform various aspects of the techniques in a reciprocal manner. While not described in detail to avoid redundancy, the techniques of this disclosure should not be strictly limited to the example of FIG. 14A.

The above section discussed the design for 5.1 compatible systems. The details may be adjusted accordingly for different target formats. As an example, to enable compatibility for 7.1 systems, two extra audio content channels are added to the compatible requirement, and two more SHC may be added to the basic set, so that the matrix is invertible. Since the majority loudspeaker arrangement for 7.1 systems (e.g., Dolby TrueHD) are still on a horizontal plane, the selection of SHC can still exclude the ones with height information. In this way, horizontal plane signal rendering will benefit from the added loudspeaker channels in the rendering system. In a system that includes loudspeakers with height diversity (e.g., 9.1, 11.1 and 22.2 systems), it may be desirable to include SHC with height information in the basic set. For a lower number of channels like stereo and mono, existing 5.1 solutions in may be enough to cover the downmix to maintain the content information.

The above thus represents a lossless mechanism to convert between a hierarchical set of elements (e.g., a set of SHC) and multiple audio channels. No errors are incurred as long as the multichannel audio signals are not subjected to further coding noise. In case they are subjected to coding noise, the conversion to SHC may incur errors. However, it is possible to account for these errors by monitoring the values of the coefficients and taking appropriate action to reduce their effect. These methods may take into account characteristics of the SHC, including the inherent redundancy in the SHC representation.

The approach described herein provides a solution to a potential disadvantage in the use of SHC-based representation of sound fields. Without this solution, the SHC-based representation may not be deployed, due to the significant disadvantage imposed by not being able to have functionality in the millions of legacy playback systems.

The techniques may therefore provide for, in a first example, a device comprising means for determining a difference in position between one of a plurality of physical speakers and one of a plurality of virtual speakers arranged in a geometry, e.g., the renderer determination unit 40, and means for adjusting a position of the one of the plurality of virtual speakers within the geometry based on the determined difference in position, e.g., the renderer determination unit 40.

In a second example, the device of the first example, wherein the means for determining the difference in position comprises means for determining a difference in elevation between the one of the plurality of physical speakers and the one of the plurality of virtual speakers, e.g., the 3D renderer determination unit 48C.

In a third example, the device of the first example, wherein the means for determining the difference in position comprises means for determining a difference in elevation between the one of the plurality of physical speakers and the one of the plurality of virtual speakers, and wherein the means for adjusting the position of the one of the plurality of virtual speakers comprises means for projecting the one of the plurality of virtual speakers to an elevation lower than an original elevation of the plurality of virtual speakers when the determined difference in elevation exceeds a threshold value, as described above in more detail with respect to the examples of FIGS. 8A-9 and 14A-16B.

In a fourth example, the device of the first examples, wherein the means for determining the difference in position comprises means for determining a difference in elevation between the one of the plurality of physical speakers and the one of the plurality of virtual speakers, and wherein the means for adjusting the position of the one of the plurality of virtual speakers comprises means for projecting the one of the plurality of virtual speakers to an elevation higher than an original elevation of the one of the plurality of virtual speakers when the determined difference in elevation exceeds a threshold value, as described above in more detail with respect to the examples of FIGS. 8A-9 and 14A-16B.

In a fifth example, the device of the first example, further comprising means for performing two dimensional panning on a hierarchical set of elements that describe a sound field when generating a plurality of loudspeaker channel signals to drive the plurality of physical speakers so as to reproduce the sound field such that the reproduced sound field includes at least one sound that appears to originate from the adjusted location of the virtual speaker, as described above in more detail with respect to the examples of FIGS. 8A and 8B.

In a sixth example, the device of the fifth example, wherein the hierarchical set of elements comprise a plurality of spherical harmonic coefficients.

In a seventh example, the device of the fifth example, wherein the means for performing two dimensional panning on the hierarchical set of elements comprises means for performing two dimensional vector based amplitude panning on the hierarchical set of elements when generating the plurality of loudspeaker channel signals, as described above in more detail with respect to the examples of FIGS. 8A and 8B.

In an eighth example, the device of the first example, further comprising means for determining one or more stretched physical speaker positions that are different from positions of the corresponding one or more of the plurality of physical speakers, as described above in more detail with respect to the examples of FIGS. 8A-12B.

In a ninth example, the device of the first example, further comprising means for determining one or more stretched physical speaker positions that are different from positions of the corresponding one or more of the plurality of physical speakers, wherein the means for determining the difference in position comprises means for determining a difference between at least one of the stretched physical speaker positions relative to the position of the one of the plurality of virtual speakers, as described above in more detail with respect to the examples of FIGS. 8A-12B.

In a tenth example, the device of the first example, further comprising means for determining one or more stretched physical speaker positions that are different from positions of the corresponding one or more of the plurality of physical speakers, wherein the means for determining the difference in position comprises means for determining a difference in elevation between at least one of the stretched physical speaker positions and the position of the one of the plurality of virtual speakers, and wherein the means for adjusting the position of the one of the plurality of virtual speakers comprises means for projecting the one of the plurality of virtual speakers to an elevation lower than an original elevation of the plurality of virtual speakers when the determined difference in elevation exceeds a threshold value, as described above in more detail with respect to the examples of FIGS. 8A-12B and 14A-16B.

In an eleventh example, the device of the first example, further comprising means for determining one or more stretched physical speaker positions that are different from positions of the corresponding one or more of the plurality of physical speakers, wherein the means for determining the difference in position comprises means for determining a difference in elevation between at least one of the stretched physical speaker positions and the position of the one of the plurality of virtual speakers, and wherein the means for adjusting the position of the one of the plurality of virtual speakers comprises means for projecting the one of the plurality of virtual speakers to an elevation higher than an original elevation of the plurality of virtual speakers when the determined difference in elevation exceeds a threshold value, as described above in more detail with respect to the examples of FIGS. 8A-12B and 14A-16B.

In a twelfth example, the device of the first example, wherein the plurality of virtual speakers are arranged in a spherical geometry, as described above in more detail with respect to the examples of FIGS. 8A-12B and 14A-16B.

In a thirteenth example, the device of the first example, wherein the plurality of virtual speakers are arranged in a polyhedron geometry. While not shown in any of the examples illustrated by the FIGS. 1-17 of this disclosure for ease of illustration purposes, the techniques may be performed with respect to any virtual speaker geometry, including any form of polyhedron geometry, such as a cubic geometry, a dodecahedron geometry, an icosidodecahedron geometry, a rhombic triacontahedron geometry, a prism geometry, and a pyramid geometry to provide a few examples.

In a fourteenth example, the device of the first example, wherein the plurality of physical speakers are arranged in an irregular speaker geometry.

In a fifteenth example, the device of the first example, wherein the plurality of physical speakers are arranged in an irregular speaker geometry on multiple different horizontal planes.

It should be understood that, depending on the example, certain acts or events of any of the methods described herein can be performed in a different sequence, may be added, merged, or left out altogether (e.g., not all described acts or events are necessary for the practice of the method). Moreover, in certain examples, acts or events may be performed concurrently, e.g., through multi-threaded processing, interrupt processing, or multiple processors, rather than sequentially. In addition, while certain aspects of this disclosure are described as being performed by a single device, module or unit for purposes of clarity, it should be understood that the techniques of this disclosure may be performed by a combination of devices, units or modules.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media, or communication media including any medium that facilitates transfer of a computer program from one place to another, e.g., according to a communication protocol.

In this manner, computer-readable media generally may correspond to (1) tangible computer-readable storage media which is non-transitory or (2) a communication medium such as a signal or carrier wave. Data storage media may be any available media that can be accessed by one or more computers or one or more processors to retrieve instructions, code and/or data structures for implementation of the techniques described in this disclosure. A computer program product may include a computer-readable medium.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. Also, any connection is properly termed a computer-readable medium. For example, if instructions are transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium.

It should be understood, however, that computer-readable storage media and data storage media do not include connections, carrier waves, signals, or other transient media, but are instead directed to non-transient, tangible storage media. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware Various embodiments of the techniques have been described. These and other embodiments are within the scope of the following claims.

What is claimed is:

1. A method comprising:

determining, by one or more processors of a device, a local speaker geometry of one or more speakers used for playback of spherical harmonic coefficients representative of a sound field;

determining, by the one or more processors, a two-dimensional or three-dimensional renderer based on the local speaker geometry; and rendering, by the one or more processors, multi-channel audio data from the spherical harmonic coefficients using the determined two-dimensional or three-dimensional renderer, the multi-channel audio data is defined in a spatial domain.

2. The method of claim 1, wherein determining the two-dimensional or three-dimensional renderer based on the local speaker geometry comprises, when the local speaker geometry conforms to a stereo speaker geometry, determining a two-dimensional stereo renderer.

3. The method of claim 1, wherein determining the two-dimensional or three-dimensional renderer based on the local speaker geometry comprises, when the local speaker geometry conforms to horizontal multi-channel speaker geometry having more than two speakers, determining a horizontal two-dimensional multi-channel renderer.

4. The method of claim 3, wherein determining the horizontal two-dimensional multi-channel renderer comprises determining an irregular horizontal two-dimensional multi-channel renderer when the determined local speaker geometry indicates an irregular speaker geometry.

5. The method of claim 3, wherein determining the horizontal two-dimensional multi-channel renderer comprises determining a regular horizontal two-dimensional multi-channel renderer when the determined local speaker geometry indicates a regular speaker geometry.

6. The method of claim 1, wherein determining the two-dimensional or three-dimensional renderer based on the local speaker geometry comprises, when the local speaker geometry conforms a three-dimensional multi-channel speaker geometry having more than two speakers on more than one horizontal plane, determining a three-dimensional multi-channel renderer.

7. The method of claim 6, wherein determining the three-dimensional multi-channel renderer comprises determining an irregular three-dimensional multi-channel renderer when the determined local speaker geometry indicates an irregular speaker geometry.

8. The method of claim 6, wherein determining the three-dimensional multi-channel renderer comprises determining a near regular three-dimensional multi-channel renderer when the determined local speaker geometry indicates a near regular speaker geometry.

9. The method of claim 6, wherein determining the three-dimensional multi-channel renderer comprises determining a regular three-dimensional multi-channel renderer when the determined local speaker geometry indicates a regular speaker geometry.

10. The method of claim 1, wherein determining the renderer comprises:

determining an allowed order of spherical basis functions to which the spherical harmonic coefficients are associated, the allowed order identifying those of the spherical harmonic coefficients that are required to be rendered given the determined local speaker geometry; and determining the renderer based on the determined allowed order.

11. The method of claim 1, wherein determining the two-dimensional or three-dimensional renderer comprises:

determining an allowed order of spherical basis functions to which the spherical harmonic coefficients are associated, the allowed order identifying those of the spherical harmonic coefficients that are required to be rendered given the determined local speaker geometry; and determining the two-dimensional or three-dimensional renderer such that the two-dimensional or three-dimensional renderer only renders those of the spherical harmonic coefficients associated with spherical basis functions having an order less than or equal to the determined allowed order.

12. The method of claim 1, wherein determining the local speaker geometry of the one or more speakers comprises receiving input from a listener specifying local speaker geometry information describing the local speaker geometry.

13. The method of claim 1, wherein determining the two-dimensional or three-dimensional renderer based on the local speaker geometry comprises, when the local speaker geometry conforms to a mono speaker geometry, determining a mono renderer.

14. A device comprising:

one or more processors configured to:

determine a local speaker geometry of one or more speakers used for playback of spherical harmonic coefficients representative of a sound field;

determine a two-dimensional or three-dimensional renderer based on the local speaker geometry; and configure the device to operate in accordance with the determined two-dimensional or three-dimensional renderer to render multi-channel audio data from the spherical harmonic coefficients, the multi-channel audio data defined in a spatial domain; and a memory coupled to the one or more processors, and configured to store the determined two-dimensional or three-dimensional renderer.

15. The device of claim 14, wherein the one or more processors are further configured to, when determining the two-dimensional or three-dimensional renderer based on the local speaker geometry, determine, when the local speaker geometry conforms to a stereo speaker geometry, a two-dimensional stereo renderer.

16. The device of claim 14, wherein the one or more processors are further configured to, when determining the two-dimensional or three-dimensional renderer based on the local speaker geometry, determine, when the local speaker geometry conforms to horizontal multi-channel speaker geometry having more than two speakers, a horizontal two-dimensional multi-channel renderer.

17. The device of claim 16, wherein the one or more processors are further configured to, when determining the horizontal two-dimensional multi-channel renderer, determine an irregular horizontal two-dimensional multi-channel renderer when the determined local speaker geometry indicates an irregular speaker geometry.

18. The device of claim 16, wherein the one or more processors are further configured to, when determining the horizontal two-dimensional multi-channel renderer, determine a regular horizontal two-dimensional multi-channel renderer when the determined local speaker geometry indicates a regular speaker geometry.

19. The device of claim 14, wherein the one or more processors are further configured to, when determining the two-dimensional or three-dimensional renderer based on the local speaker geometry, determine, when the local speaker geometry conforms a three-dimensional multi-channel speaker geometry having more than two speakers on more than one horizontal plane, a three-dimensional multi-channel renderer.

20. The device of claim 19, wherein the one or more processors are further configured to, when determining the three-dimensional multi-channel renderer, determine an irregular three-dimensional multi-channel renderer when the determined local speaker geometry indicates an irregular speaker geometry.

21. The device of claim 19, wherein the one or more processors are further configured to, when determining the three-dimensional multi-channel renderer, determine a near regular three-dimensional multi-channel renderer when the determined local speaker geometry indicates a near regular speaker geometry.

22. The device of claim 19, wherein the one or more processors are further configured to, when determining the three-dimensional multi-channel renderer, determine a regular three-dimensional multi-channel renderer when the determined local speaker geometry indicates a regular speaker geometry.

23. The device of claim 14, wherein the one or more processors are configured to determine an allowed order of spherical basis functions to which the spherical harmonic coefficients are associated, the allowed order identifying those of the spherical harmonic coefficients that are required to be rendered given the determined local speaker geometry, and determine the renderer based on the determined allowed order.

24. The device of claim 14, wherein the one or more processors are configured to determine an allowed order of spherical basis functions to which the spherical harmonic coefficients are associated, the allowed order identifying those of the spherical harmonic coefficients that are required to be rendered given the determined local speaker geometry, and determine the two-dimensional or three-dimensional renderer such that the two-dimensional or three-dimensional renderer only renders those of the spherical harmonic coefficients associated with spherical basis functions having an order less than or equal to the determined allowed order.

25. The device of claim 14, wherein the one or more processors are configured to receive input from a listener specifying local speaker geometry information describing the local speaker geometry.

26. The device of claim 14, wherein the one or more processors are configured to determine, when the local speaker geometry conforms to a mono speaker geometry, a mono renderer.

27. A non-transitory computer-readable storage medium having stored thereon instructions that, when executed, cause one or more processors to:

determine a local speaker geometry of one or more speakers used for playback of spherical harmonic coefficients representative of a sound field;

determine a two-dimensional or three-dimensional renderer based on the local speaker geometry; and render the spherical harmonic coefficients using the determined two-dimensional or three-dimensional renderer to generate multi-channel audio data, the multi-channel audio data defined in a spatial domain.

28. The method of claim 1, further comprising reproducing, by the one or more speakers coupled to the one or more processors, the sound field based on the multi-channel audio data.

29. The device of claim 14, further comprising the one or more speakers, the one or more speakers coupled to the one or more processors, and configured to reproduce the sound field based on the multi-channel audio data.

* * * * *